US007954979B2

(12) United States Patent
Sommers et al.

(10) Patent No.: US 7,954,979 B2
(45) Date of Patent: Jun. 7, 2011

(54) LED LIGHTING SYSTEMS FOR PRODUCT DISPLAY CASES

(75) Inventors: Mathew Sommers, Sagamore Hills, OH (US); Mark Mayer, Sagamore Hills, OH (US); Chris Bohler, North Royalton, OH (US); James Petroski, Parma, OH (US); Melissa Wesorick, Pepper Pike, OH (US)

(73) Assignee: GE Lighting Solutions, LLC, Cleveland, OH (US)

( * ) Notice: Subject to any disclaimer, the term of this patent is extended or adjusted under 35 U.S.C. 154(b) by 213 days.

(21) Appl. No.: 11/137,598

(22) Filed: May 25, 2005

(65) Prior Publication Data

US 2005/0265019 A1 Dec. 1, 2005

Related U.S. Application Data

(63) Continuation-in-part of application No. 11/029,843, filed on Jan. 5, 2005, now Pat. No. 7,170,751.

(60) Provisional application No. 60/574,625, filed on May 26, 2004.

(51) Int. Cl.
*F21V 21/00* (2006.01)

(52) U.S. Cl. ..... 362/217.01; 362/92; 362/125; 362/133; 362/249.01; 362/294

(58) Field of Classification Search ..... 362/127, 362/133, 134, 800, 545, 92, 125, 217.01, 362/217.02, 217.04, 217.05, 217.08, 21, 362/7.09, 217.1, 217.11, 217.12, 217.13, 362/217.14, 217.15, 218–225, 235, 240–248, 362/249.01, 249.02, 255, 297, 326–328, 362/341, 373, 455

See application file for complete search history.

(56) References Cited

U.S. PATENT DOCUMENTS

| | | | | |
|---|---|---|---|---|
| 4,733,335 | A * | 3/1988 | Serizawa et al. | 362/503 |
| 5,495,147 | A | 2/1996 | Lanzisera | |
| 5,895,111 | A | 4/1999 | Santosuosso et al. | |
| 5,902,034 | A | 5/1999 | Santosuosso et al. | |
| 6,354,098 | B1 | 3/2002 | Bardin et al. | |
| 6,550,269 | B2 | 4/2003 | Rudick | |
| 6,561,690 | B2 * | 5/2003 | Balestriero et al. | 362/555 |
| 6,578,978 | B1 | 6/2003 | Upton et al. | |
| 6,578,979 | B2 | 6/2003 | Truttmann-Bättig | |
| 6,641,284 | B2 * | 11/2003 | Stopa et al. | 362/240 |
| 6,659,623 | B2 * | 12/2003 | Friend | 362/249.06 |
| 6,726,341 | B2 | 4/2004 | Pashley et al. | |
| 6,964,507 | B2 * | 11/2005 | Mohacsi | 362/545 |
| 7,033,060 | B2 * | 4/2006 | Dubuc | 362/600 |

(Continued)

FOREIGN PATENT DOCUMENTS

DE 101 05 622 A1 8/2002

(Continued)

OTHER PUBLICATIONS

Communication Relating to the Results of the Partial International Search.

*Primary Examiner* — Hargobind S Sawhney
(74) *Attorney, Agent, or Firm* — Fay Sharpe LLP

(57) ABSTRACT

A lighting assembly for illuminating a display case includes an LED that illuminates items placed in the display case. The lighting assembly can attach to a door, a door frame, or another structure of the display case.

17 Claims, 18 Drawing Sheets

U.S. PATENT DOCUMENTS

| | | | | |
|---|---|---|---|---|
| 2002/0036908 | A1* | 3/2002 | Pederson | 362/545 |
| 2002/0044456 | A1 | 4/2002 | Balestriero et al. | |
| 2002/0056287 | A1 | 5/2002 | Rudick | |
| 2002/0125839 | A1 | 9/2002 | Yen | |
| 2003/0048641 | A1 | 3/2003 | Alexanderson et al. | |
| 2003/0137828 | A1 | 7/2003 | Ter-Hovhannisian | |
| 2003/0174517 | A1 | 9/2003 | Kiraly | |
| 2004/0037087 | A1* | 2/2004 | Desai | 362/541 |
| 2005/0174802 | A1* | 8/2005 | Wu et al. | 362/602 |
| 2006/0013002 | A1* | 1/2006 | Coushaine et al. | 362/308 |
| 2006/0268535 | A1* | 11/2006 | Kraus | 362/23 |

FOREIGN PATENT DOCUMENTS

| | | | |
|---|---|---|---|
| EP | 1 231 432 | A2 | 8/2002 |
| WO | WO 01/00065 | | 1/2001 |
| WO | WO 03/095894 | | 11/2003 |
| WO | WO 03/102467 | | 12/2003 |
| WO | WO 03/102467 | A2 | 12/2003 |

* cited by examiner

LED LIGHTING SYSTEMS FOR PRODUCT DISPLAY CASES

This application claims the benefit of U.S. Provisional Application Ser. No. 60/574,625 filed May 26, 2004, the entirety of which is incorporated by reference. This application is also a continuation-in-part of U.S. patent application Ser. No. 11/029,843 filed Jan. 5, 2005, now U.S. Pat. No. 7,170,751 the entirety of which is incorporated by reference herein.

BACKGROUND

Lighting systems are used to illuminate display cases, such as commercial refrigeration units, as well as other display cases that need not be be refrigerated. Typically, a fluorescent tube is used to illuminate products disposed in the display case. Fluorescent tubes do not have nearly as long a lifetime as a typical LED. Furthermore, for refrigerated display cases, initiating the required arc to illuminate a fluorescent tube is difficult in a refrigerated compartment.

LEDs have also been used to illuminate refrigerated display cases. These known systems, however, employ LEDs that emit light at a narrow angle and include complicated optics and reflectors to disperse the light.

With reference to FIG. 1, a typical refrigerated case 10 has a door and frame assembly 12 mounted to a front portion of the case. The door and frame assembly 12 includes side frame members 14 and 16 and top and bottom frame members 18 and 22 that interconnect the side frame members. Doors 24 mount to the frame members via hinges 26. The doors include glass panels 28 retained in frames 32 and handles 34 may be provided on the doors. Mullions 36 mount to the top and bottom frame members 18 and 22 to provide door stops and points of attachment for the doors 24 and/or hinges 26.

The enclosure 10 described can be a free-standing enclosure or a built-in enclosure. Furthermore, other refrigerated enclosures may include a different configuration, for example a refrigerated enclosure may not even include doors. The lighting systems provided in this application can also be used with those types of refrigerated enclosures, as well as in a multitude of other applications.

SUMMARY

A lighting assembly for illuminating a display case includes an LED device, an elongated heat sink, and a reflector. The LED device can include a side emitting LED or a lambertian device. The side emitting LED lens directs light emanating from the LED. The elongated heat sink is in thermal communication with the LED. And the reflector is disposed in relation to the LED to reflect light emitted from the LED through the lens.

A light assembly for illuminating opposite sides of a mullion in a refrigerated display case includes a plurality of LEDs, a thermally conductive printed circuit board, a heat sink, a mounting structure and a reflector. The LEDs are mounted to the circuit board. The heat sink is in thermal communication with the circuit board. The mounting structures connect to the heat sink and are adapted to mount to a mullion of an associated display case. The reflector and the LEDs cooperate to direct light to opposite sides of the mullion.

An illuminated display case includes an enclosure, a door connected to the enclosure, an LED, and conductors. The door provides access to the enclosure and includes a panel through which items can be seen that are disposed in the enclosure. The LED mounts to the panel. Conductors mount to the panel for providing power to the LED.

A lighting assembly for use in a display case includes an LED, a support, and a reflector. The support is adapted to attach to at least one of a shelf and a door frame adjacent the shelf of an associated display case. The reflector attaches to the support. The reflector is shaped and disposed in relation to the LED such that the reflector directs light from the LED above and below the shelf.

DETAILED DESCRIPTION

Figure 1:
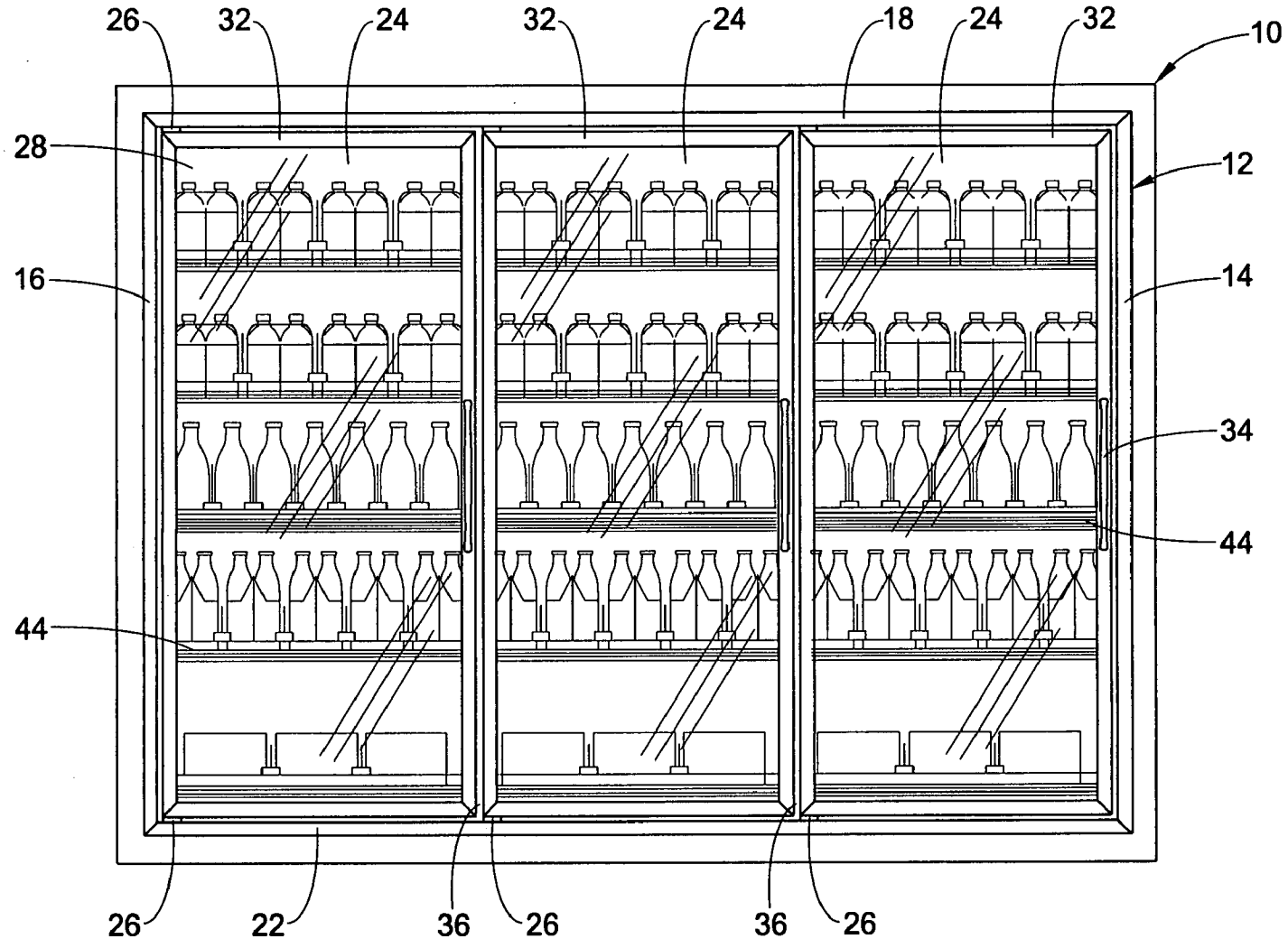
FIG. 1 is a front view of a refrigerated enclosure.
Figure 2:
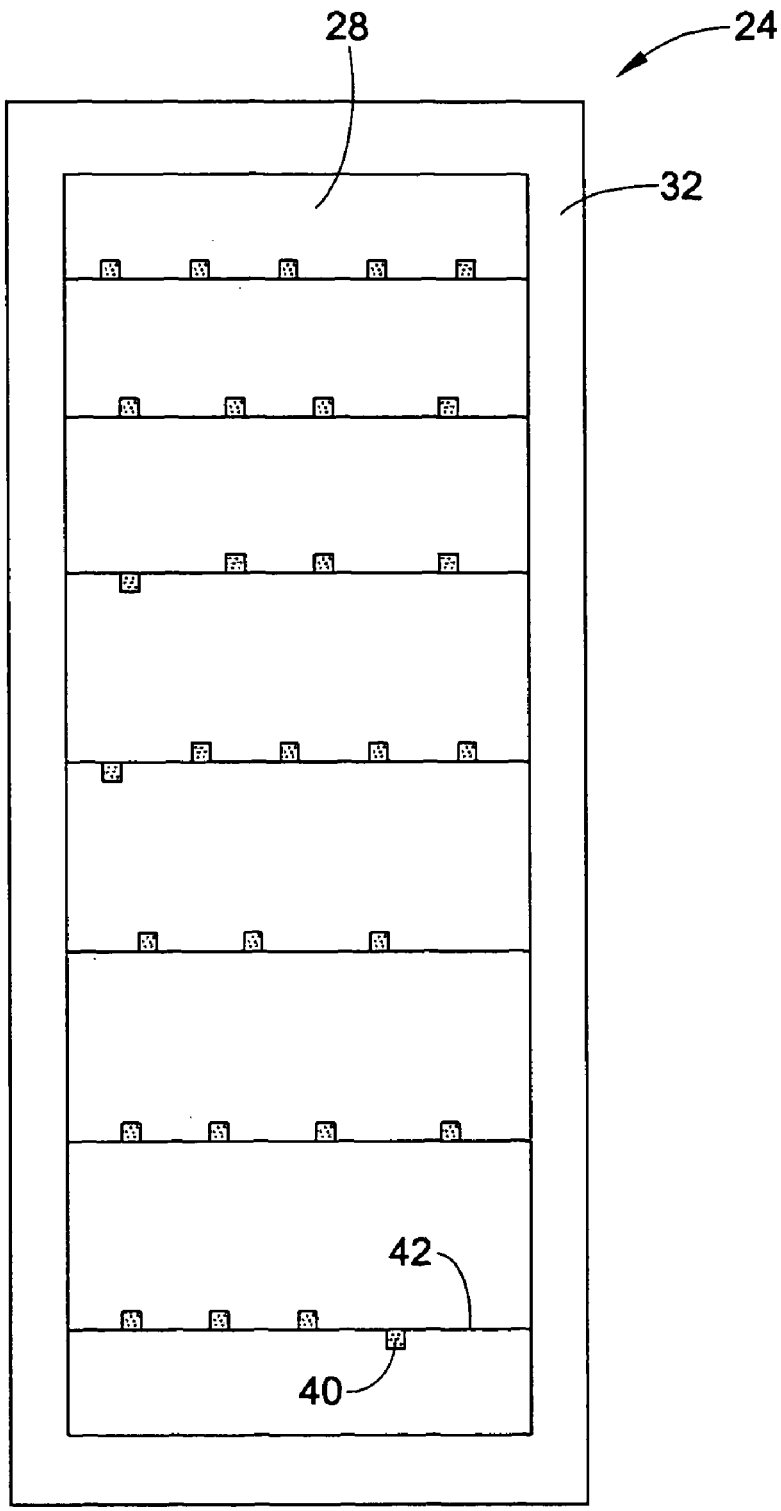
FIG. 2 is a schematic view of a door that can mount to the refrigerated enclosure of FIG. 1 employing a lighting system according to an embodiment of the present invention.

LEDs can illuminate the products stored in display cases, such as a refrigerated enclosure 10 depicted in FIG. 1. A first lighting system is depicted in FIG. 2. A plurality of LEDs 40 mount to the glass panel 28 of the door 24. Each LED 40 can be very small in size so that the visibility of the product is not significantly reduced. The LEDs 40 can include an LED assembly that can create a lambertian radiation pattern. An LED assembly that creates a lambertian radiation pattern generally provides a wider, flat radiation pattern, as compared to other known LEDs. Such lambertian devices are available from Lumileds Lighting, U.S., LLC. The LEDs 40 can be connected to one another and to a power supply (not shown) via traces or wires 42 which can be very thin copper traces placed directly on or embedded into the glass. Likewise, the LEDs 40 can also be embedded into the glass 28 or be placed between panels in a multi-paned door. The LEDs can be placed directly in front of the product, i.e. offset from the shelf that supports the product. The LEDs can be evenly spaced over the glass panel 28, e.g. the LEDs can be placed in an even array across the glass panel, so that the LED system as a whole appears transparent except for small localized dots for where the LEDs 40 and traces 42 reside.

In an alternative embodiment, a conductive transparent film can be spread over the glass panel 28 and the LEDs 40 can be mounted to the film. The film can be applied at the OEM factory or as a retro fit. The LEDs 40 can be of any color, and one embodiment can be provided with LEDs of a cooler color such as blue, to connote a cooler temperature in the enclosure 10.

Figure 3:
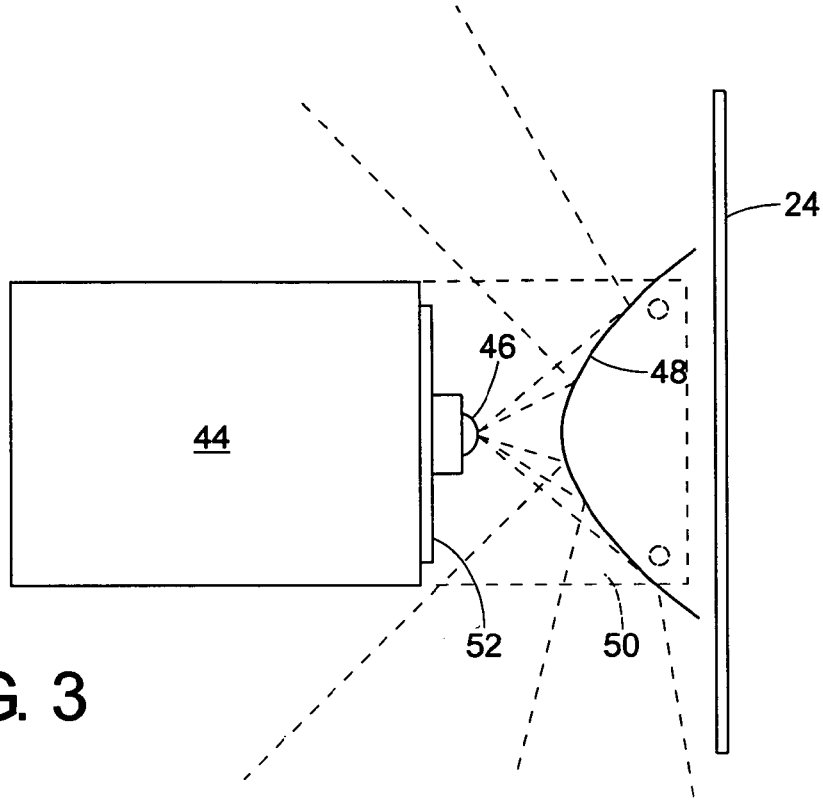
FIG. 3 is a schematic view of a shelf that can mount in the enclosure of FIG. 1 employing a lighting system according to an embodiment of the present invention.

With reference back to FIG. 1, the enclosure 10 is provided with a plurality of shelves 44 upon which the product is stored. With reference to FIG. 3, a plurality of LEDs 46 (only one shown) mount to a front surface of the shelf 44, the front surface being the surface facing the door 24 of the refrigerated enclosure 10. The LEDs 46 can include the aforementioned lambertian devices. A reflector 48 is interposed between the LED 46 and door 24. The reflector 48 directs light emitted from the LED 46 towards the product supported by the shelf 44 and towards the product supported by the shelf below. In the embodiment depicted, the reflector 48 has a smooth curved configuration; however, the reflector can be other configurations, for example include a faceted surface. The reflector 48 can mount to the shelf 44 via mounts 50 (shown in phantom) spaced along the length of the reflector. The mounts 50 can attach at or near the ends of the shelf 44. Providing the mounts 50 at the ends of the shelf 44 allows the reflector 48 to direct light to both the product supported by the shelf 44, i.e. above the shelf, and to direct light towards the product supported by the shelf below without blocking any light. Alternatively, the reflector 48 can attach to the mullions 36 (FIG. 1). The reflector can comprise metal, plastic, plastic covered with a film, and transparent plastic using the method of total internal reflection to direct light similar to a conventional reflector, as well as other conventional materials. The surfaces can also be polished to further increase the efficacy.

In one embodiment, an isolative stand off 52, e.g. a printed circuit board having a thermally isolative layer adjacent the shelf 44 that hinders thermal conduction between the standoff and the shelf, can be interposed between the LED 46 and the shelf 44. The stand off 52 aids in the dissipation of heat generated by the LED 46 so that heat generated by the LED is not transferred to the product stored on the shelf 44.

The reflector 48 can be provided with a channel or the like, to allow pricing and other information to be displayed on the backside, i.e. the portion that does not reflect light. One such price tag holding system is described in U.S. Pat. App. Pub. No. 2003/0137828, which is incorporated by reference. Other price tag mounting structures can be provided on the reflector such as surfaces to which adhesives can be applied, clips and the like.

Figure 4:
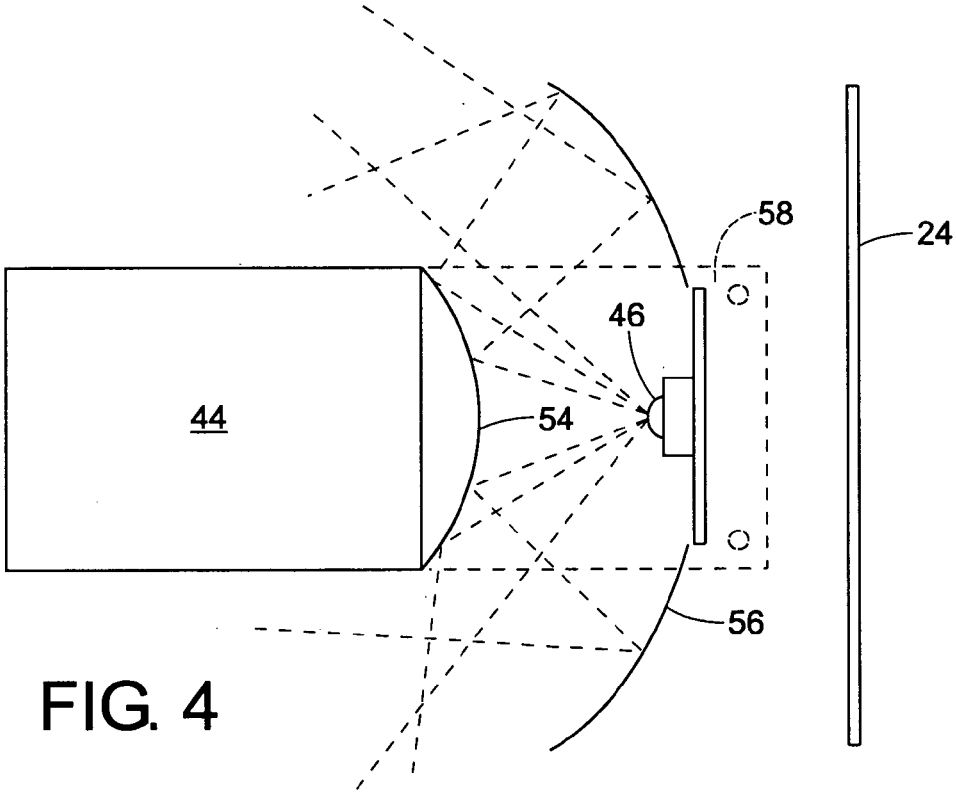
FIG. 4 is an alternative embodiment of FIG. 3.

With reference to FIG. 4, the LED 46 directs light toward a first reflector 54 mounted to the shelf 44 and the first reflector 54 directs light towards a second reflector 56 which directs light above and below the shelf 44. The first reflector 54 and the second reflector 56 are cooperatively shaped to direct the light towards the products stored on the shelves 44. In one embodiment, the upper portion of the second reflector 56 may take a different configuration than the lower portion of the second reflector to maximize the distribution of light towards products stored on the shelves. The second reflector 56 attaches to the shelf 44 and/or the enclosure 10 in a similar manner to the reflector 48 shown in FIG. 3, e.g. a mount 58 (shown in phantom). Similar to the embodiment depicted in FIG. 3, the mount 58 can be located at or near the end of the shelf 44. The LED 46 is located in the vertical center of the second reflector 56; however, the LED can be located elsewhere.

In addition to being mounted to the shelves 44 of the enclosure 10 and the doors 24 of the enclosure 10, LEDs can also mount to the mullions 36 of the enclosure, as well as to the sides of the enclosure.

Figure 5:
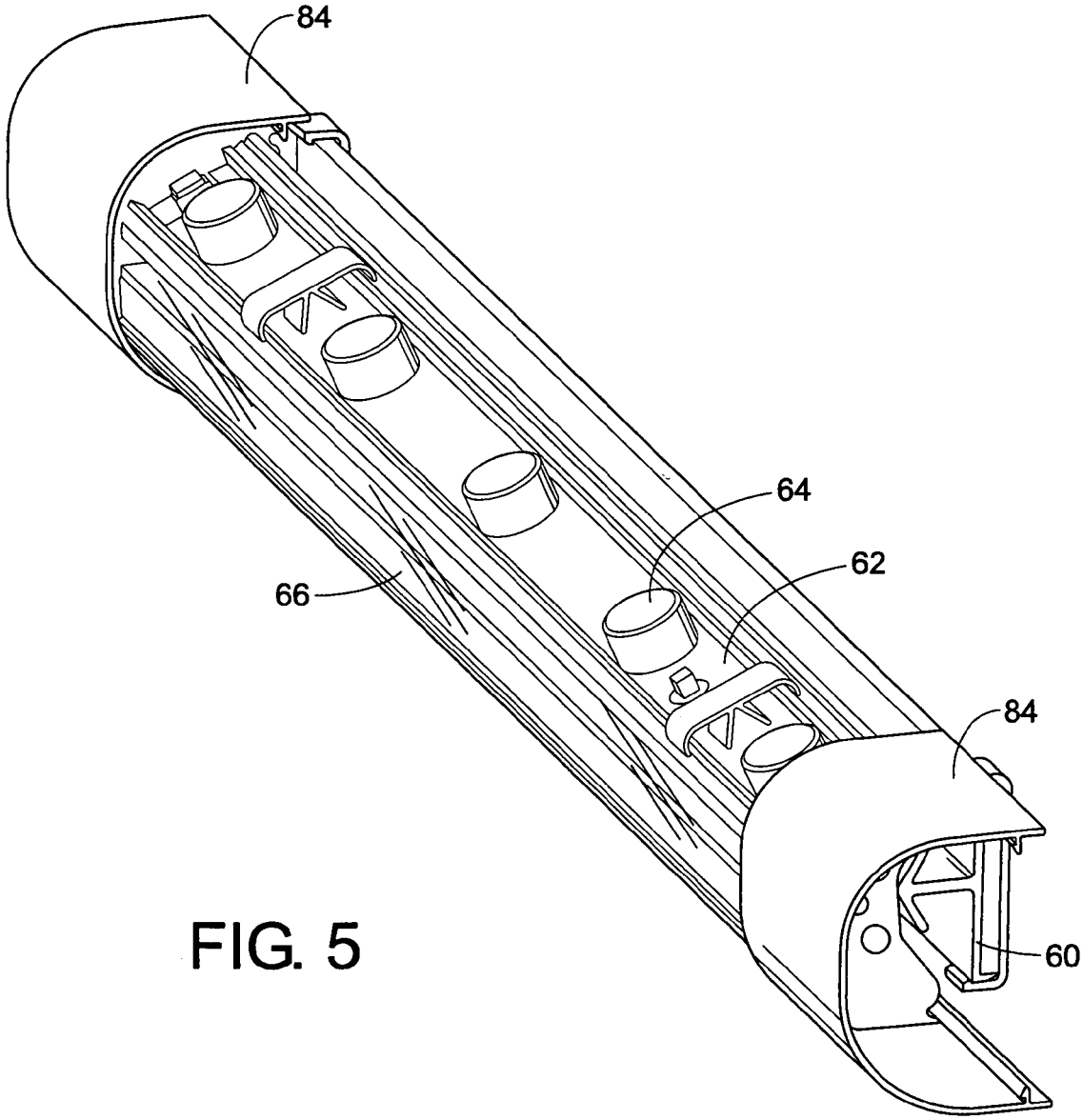
FIG. 5 is a perspective view of a lighting system that can be used with the refrigerated enclosure of FIG. 1.
Figure 6:
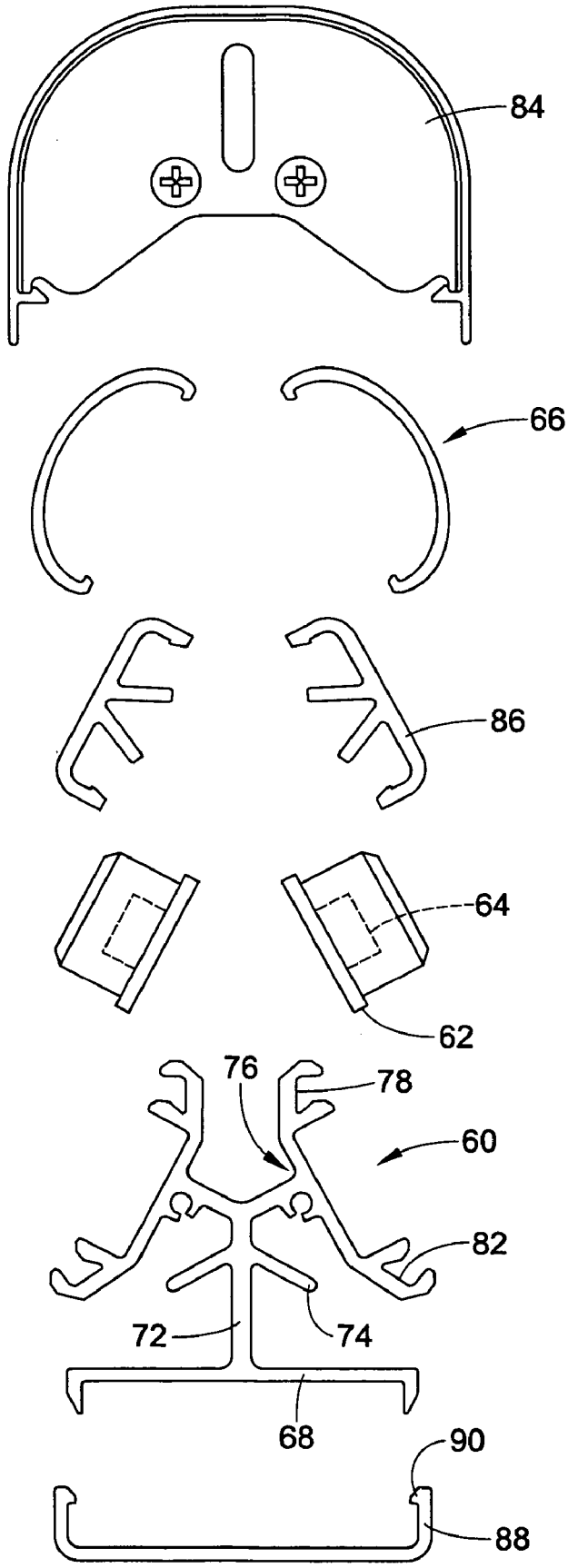
FIG. 6 is an exploded side view of the lighting system of FIG. 5.
Figure 7:
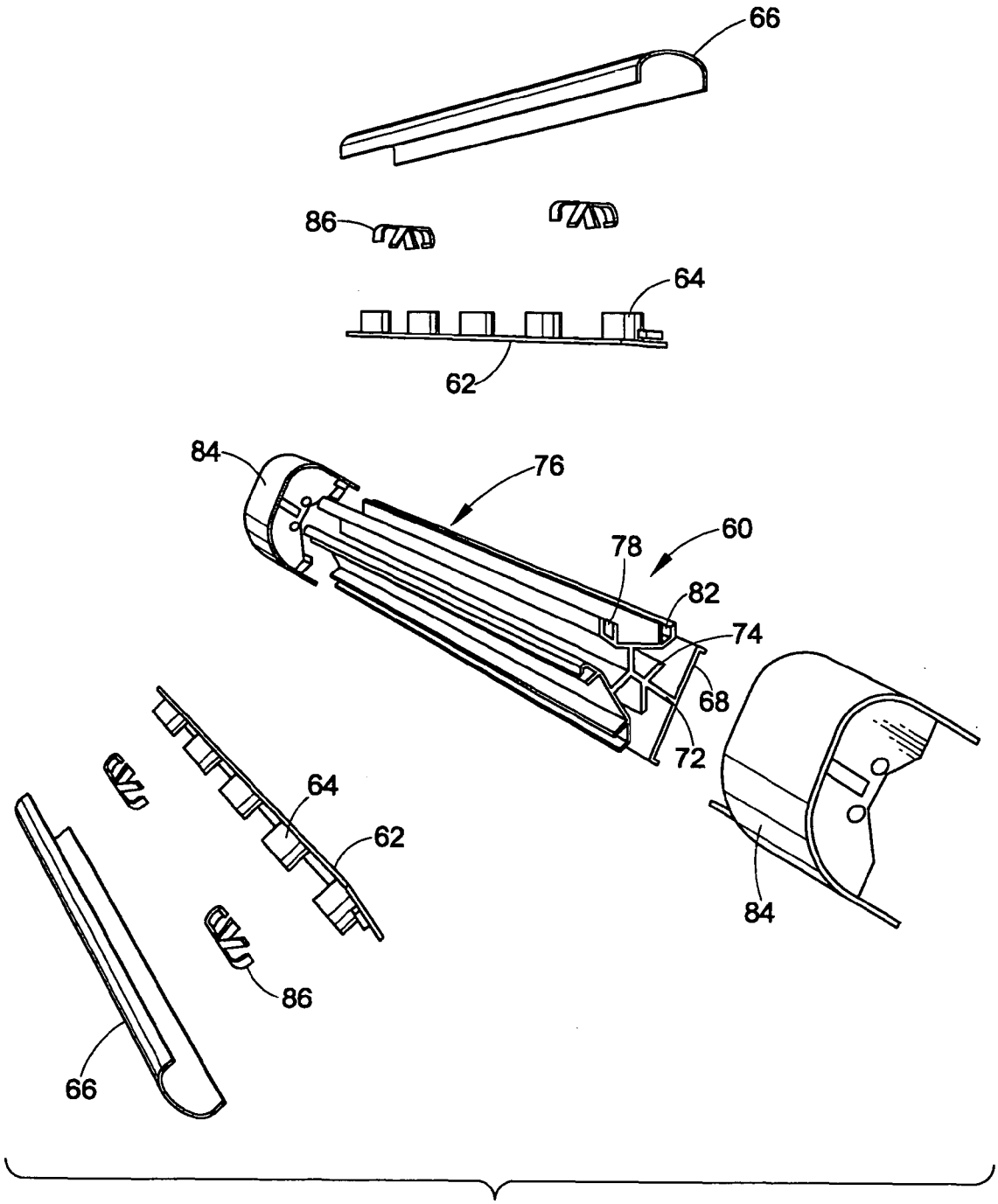
FIG. 7 is an exploded perspective view of the lighting system of FIG. 5.
Figure 8:
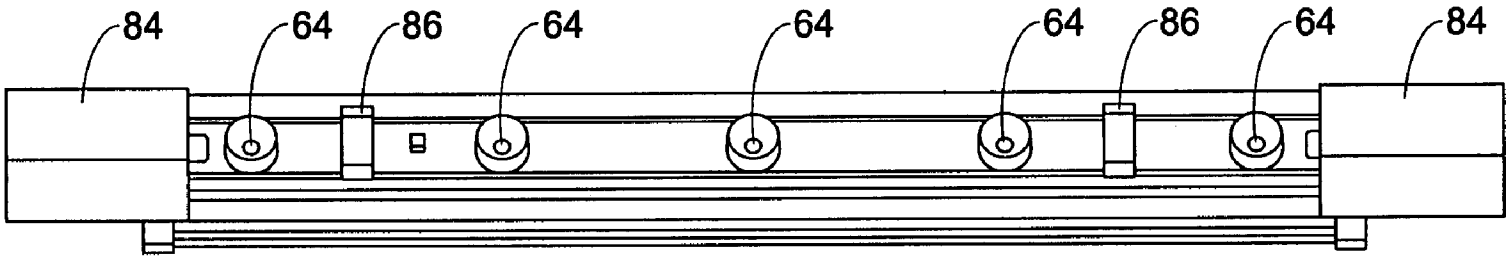
FIG. 8 is a side view of the lighting system of FIG. 5.

With reference to FIG. 5, a lighting system that mounts to the mullion 36 (FIG. 1) of the enclosure 10 includes a mounting structure 60, a metal clad or metal core printed circuit board or printed circuit board 62, a plurality of high power LEDs 64, a protective lens 66 and a power supply (not shown). The LEDs 64 can include the aforementioned lambertian devices. As seen in FIG. 6, the mounting structure 60 includes a base 68 having an extension 72 protruding normal to the longitudinal central portion of the base along the length of the mounting structure. In the embodiment depicted in FIG. 5, the mounting structure 60 is symmetrical, and for the sake of brevity only one side thereof will be described. Fins 74 extend outwardly from the extension 72 spaced from the base 68. A light strip mounting structure 76 also protrudes from the extension 72 spaced from the fin 74 and the base 68. The light strip mounting structure 76 includes an upper lens receptacle 78 and a lower lens receptacle 82. The lens receptacles 78 and 82 are defined by a pair of fingers between which a portion of the protective lens 66 is inserted; however, other structures can be provided to attach the protective lens to the mounting structure 60.

The circuit board 62 fits on the light strip mounting structure 76 between the upper lens receptacle 78 and the lower lens receptacle 82. The two light strip mounting structures 76 are angled in relation to the base 68, therefore in relation to the mullion 36, so that light can be directed toward the product stored on opposite sides of the mullion. The mounting structure 60 can be made of extruded aluminum to promote the thermal transfer of heat generated by the LEDs 64 into the mounting structure 60. The mounting structure 60 can be made of other materials, preferably materials that will promote the heat sink capability of the mounting structure 60. Two light strips containing a plurality of LEDs 64 can be mounted to the mounting structure 60 where each light strip faces a different direction such that two different sides of the mullion 36 (FIG. 1) can be lit.

The protective lens 66 can slide into the respective upper lens receptacle 78 and lower lens receptacle 82. End caps 84 attach to opposite ends of the lens 66 and the mounting structure 60 to enclosure the plurality of LEDs 64. The lens 66 can contain specialized optics that direct the light from the LEDs 64 toward the products displayed on the shelves 44 of the refrigerated case 10. The optics on the lens can include dioptrics, catadioptrics and TIR optics specifically located close to the LEDs 64. Alternatively, the lens 66 can comprise a translucent cover that simply allows light to pass through. The lens 66, the mounting structure 60 and/or the end caps 84 can include vent holes (not shown) to allow cool air from the refrigerated case 10 to infiltrate the system to promote the cooling of the LEDs 64.

The circuit board 62 fits between the upper lens receptacle 78 and the lower lens receptacle 82. The circuit board contains components to enable the LEDs 64 to be powered through an external power supply (not shown). The circuit board 62 can contain trim resisters, electronics that separate out a known polarity from an unknown polarity source, electronics to protect from an over voltage conditions, AC to DC power conversion electronics, and the like. The electronics on the circuit board 62 can also condition the power such that the LEDs can be powered from a fluorescent ballast. In another embodiment, the LEDs 64 can receive power via a flexible electrical cord or some other power delivery source obviating the need for mounting the LEDs 64 to the circuit board.

The power supply driving the LEDs 64 can be located adjacent to or remotely from the LEDs. In one embodiment the power supply is sized such that it fits into a similar size location as a standard fluorescent ballast currently being used with conventional refrigerated cases. This power supply is designed with high efficiency and multiple options. Such options include ability to dim the LEDs 64, a timer control for the LEDs, proximity sensing control, temperature warning indicators, active LED control for differentiation of products stored in the refrigerated case, and remote control. The proximity sensing control can detect a passerby of the enclosure case 10 and, for example, supply more power to the LEDs 64 in response thereto. Such a motion sensor device can include known motion sensors that are used with lights, for example outdoor lights. These motion sensor devices are well known in the art. The temperature warning indicators can supply a signal so that the LEDs flash or turn colors in response to a predetermined temperature being measured by a sensor in the refrigerated case 10. The power supply can be controlled such that some products stored in the case 10 are lit differently than other products (i.e., different colors, different brightness or flashing) to differentiate the products stored in the refrigerated case.

The end caps 84 along with the lens 66 can enclose the LEDs 64. The end caps 84 can be designed to allow ease of connection to the power supply. Similar to a conventional fluorescent tube, a bi-pin connector (not shown) can connect to the circuit board 62 and extend from the end cap 84. Such a bi-pin connector can be received in a ballast similar to a conventional fluorescent ballast. A rotating cam lock can be integrated into the lens end cap 84 to allow close connection of the plurality of LEDs 64 on the circuit board 62 to the mounting structure 60. For use in a retrofit situation, conditioning electronics can be provided on or adjacent the circuit board 62 and/or the LEDs 64 to condition the electricity from a fluorescent ballast so that the high power LEDs can be powered through the fluorescent ballast. In such an embodiment the bi-pin connector can twist on similar to a conventional fluorescent tube.

In retrofit situations, or situations where it is desirable to provide a system that can employ fluorescent tubes, the existing wiring and power supplies used to run the fluorescent tubes can also electrically connect to lighting system of or similar to FIG. 5. Such an embodiment can include a polarity correction circuit (not shown) in electrical communication with the LEDs 64. By allowing the lighting system to fit into known fluorescent tube connection terminals, retrofitting of the system can be performed easily and quickly.

Figure 9:
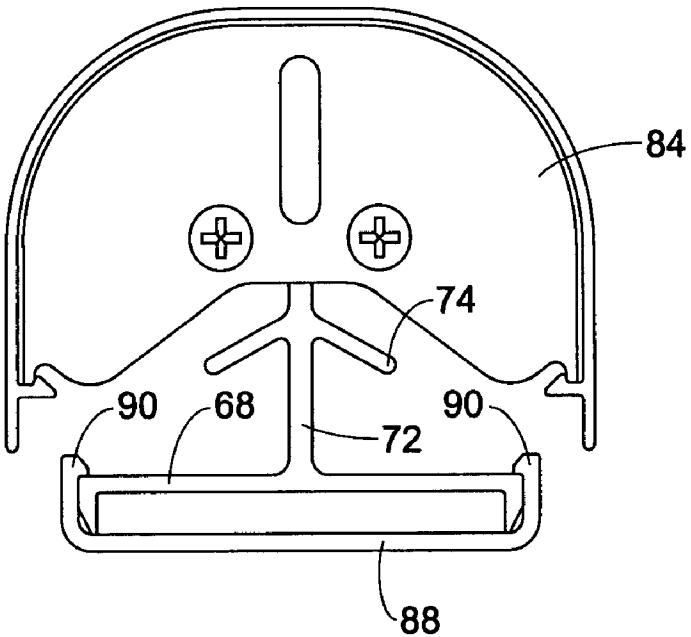
FIG. 9 is an end view of the lighting system of FIG. 5.

With reference back to FIG. 5, clips 86 can be provided to secure the circuit board 62 to the light strip mounting structure 76 of the mounting structure 60. Other retaining mechanisms can be used to mount the circuit board 62 to the mounting structure 60 including adhesives, other conventional fasteners, and the like. Also, a plurality of mounting clips 88 attach to the base 68 of the mounting structure 60. The mounting clips 88 allow for attachment of the mounting structure 60 to the mullion 36 (FIG. 1). The mounting clips 88 snap onto or receive the base 68 of the mounting structure. As seen in FIG. 9, the mounting clips 88 include small knurls 90 that engage the mounting structure 60.

In an alternative embodiment to the lighting system attached to the mullions 36, a system similar to the system that mounts to the shelves (FIGS. 3 and 4) can be employed. In this embodiment, the mounting structure 60 can attach to the shelves 44 in a manner similar to that disclosed in FIG. 3. Alternatively, the mounting structure can mount to the mullions 36 or the shelves 44 in a manner similar to the embodiment described with reference to FIG. 4.

Figure 10:
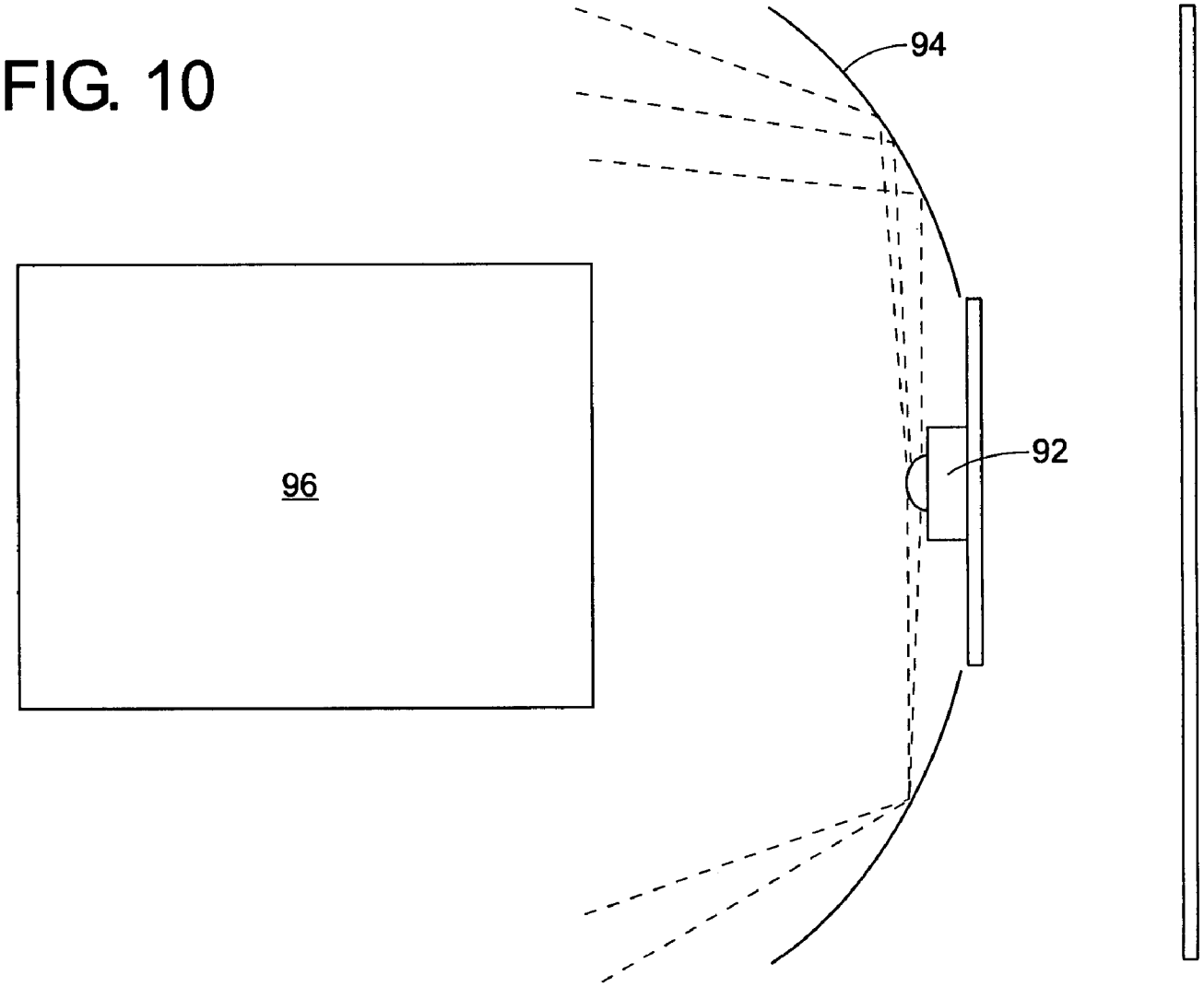
FIG. 10 is a schematic view of a shelf that can mount in the enclosure of FIG. 1 employing a lighting assembly according to an embodiment of the present invention.

With reference to FIG. 10, an alternative LED 92 is shown. The LED 92 is a side-emitting LED, which is an LED where a majority of the emitted light is directed sideways, i.e., parallel to a base of the LED, and very little light is emitted in a forward direction. Such an LED can be used in a vertically oriented lighting system similar to that disclosed with reference to FIG. 5. Also, the side-emitting LED 92 can be used in a system similar to that described with reference to FIGS. 3 and 4. With continued reference to FIG. 10, the side-emitting LED 92 emits light that is directed towards a reflector 94 which directs the light towards products (not shown) stored on a shelf 96. The attachment of the LED and the reflector is similar to that described with reference to FIGS. 3 and 4 as well as the attachment described with reference to the lighting system described in FIG. 5. The reflector is shaped to reflect light above and below the shelf 96 and the upper portion of the reflector can be differently shaped than the lower portion. For example, the upper portion of the reflector may be shaped to direct light towards the bottom of the product stored on the shelf 96 while the lower portion of the reflector 94 is positioned to direct light towards the upper portion of the product stored on the shelf below (not shown). As indicated above, a plurality of side-emitting LEDs can be provided running along the reflector 94. In an embodiment similar to that disclosed with reference to FIG. 5, use of the side-emitting LEDs 92 can obviate the need for two sets of LEDs directed to opposite sides of the mullion 36. Such a configuration can also hide the LEDs from the consumer, which may be more pleasing in that the bright spots generated by the LED are not visible to the consumer, but only the reflector 94 would be visible. In addition to, or instead of using the side-emitting LEDs for these embodiments, lambertian devices, which also generate a wide radiation pattern, can also be used with these embodiments.

Figure 11:
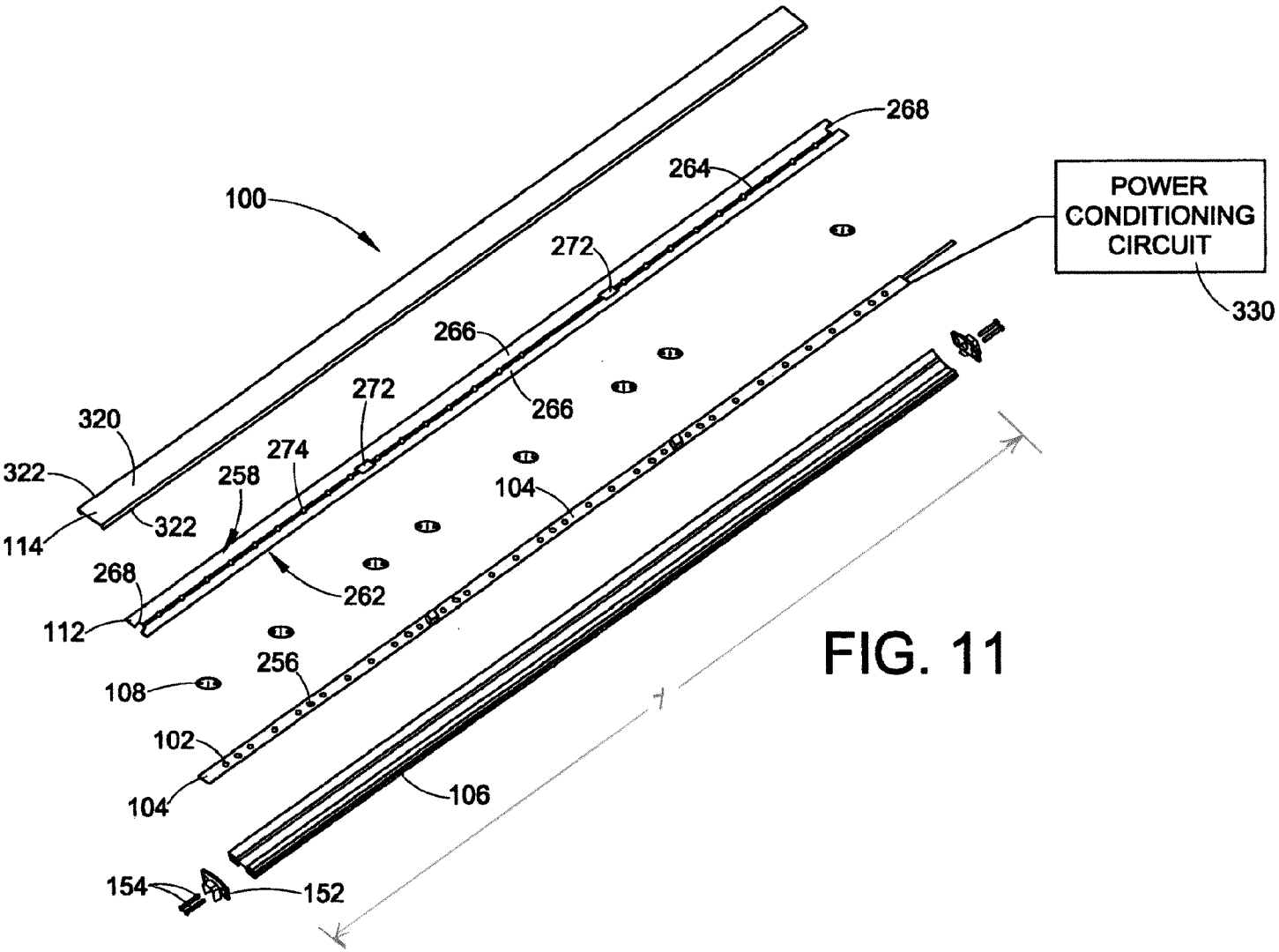
FIG. 11 is an exploded view of an alternative embodiment of a lighting assembly for use in a display case, an example of which being the refrigerated enclosure of FIG. 1.

With reference to FIG. 11, another embodiment of a lighting assembly 100 is disclosed. The lighting assembly includes a plurality of LEDs 102 mounted on printed circuit boards 104. The printed circuit boards 104 mount to a heat sink 106 using fastening devices 108. A reflector 112 also connects to the heat sink 106. A translucent cover 114 also attaches to the heat sink 106 and covers the LEDs 102.

Figure 12:
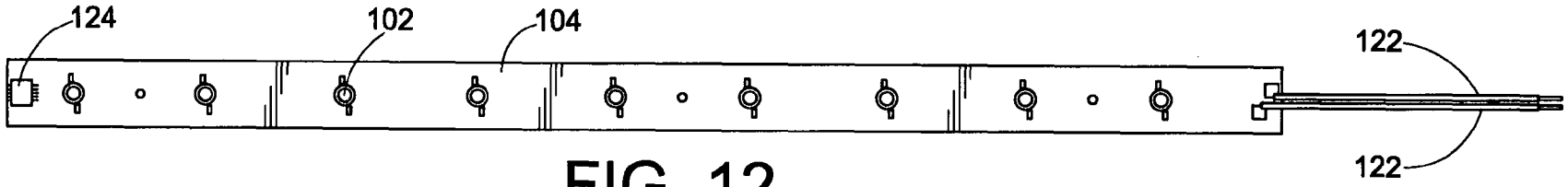
FIG. 12 is a plan view of a metal core printed circuit board ("MCPCB") and LEDs of the lighting assembly of FIG. 11.
Figure 13:
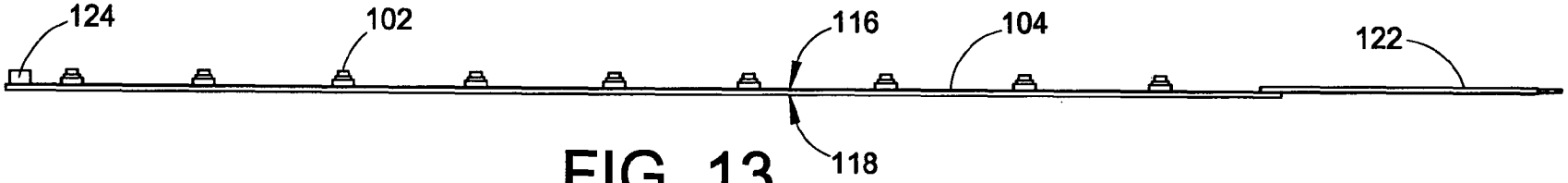
FIG. 13 is a side elevation view of the MCPCB and LED assembly of FIG. 12.

With reference to FIGS. 12 and 13, the printed circuit board 104 in the depicted embodiment is a metal core printed circuit board ("MCPCB"); however other circuit boards can be used. The MCPCB 104 has a long rectangular configuration that cooperates with the heat sink 106 (FIG. 11) to remove heat from the LEDs 102. In an alternative embodiment, the LEDs can be electrically connected via flexible conductors similar to a string light engine. With reference to FIG. 13, the printed circuit board 104 includes a plurality of traces (not shown) interconnecting the LEDs. The traces are formed in a dielectric layer that is disposed on a first, or upper, surface 116 of the MCPCB 104. The contacts are in thermal communication with a metal core portion of the MCPCB 104, which is disposed below the dielectric layer. The MCPCB 104 includes a second, or lower, surface 118 opposite the upper surface 116. Heat from the LEDs 102 is drawn through the metal core portion of the MCPCB 104 and dissipated through the lower surface 118 into the heat sink 106 (FIG. 11).

Figure 14:
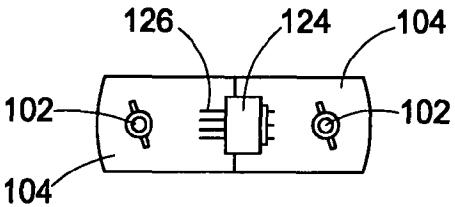
FIG. 14 is a plan view of the connection between two adjacent MCPCBs of the lighting assembly of FIG. 11.

As seen in FIGS. 12 and 13, a plurality of LEDs 102 mount on the upper surface 116 of the MCPCB 104. Wire conductors 122 extend from the MCPCB 104 and are connected to the traces, which are connected to the LEDs 102. The conductors 122 connect to a power source, which will be described in more detail below. A socket strip connector 124 is disposed at an opposite end of the MCPCB 104 from the conductive wires 122. The socket strip connector 124 mounts to the upper surface 116 of the MCPCB 104 and is connected to the traces, which are connected to the LEDs 102. The socket strip connector 124 in this arrangement is a female-type electrical receptacle. With reference to FIG. 14, a male electrical connection 126, which is mounted on an adjacent MCPCB 104 (see FIG. 11), is inserted into the female socket strip connector 124 for connecting one MCPCB to another.

Figure 15:
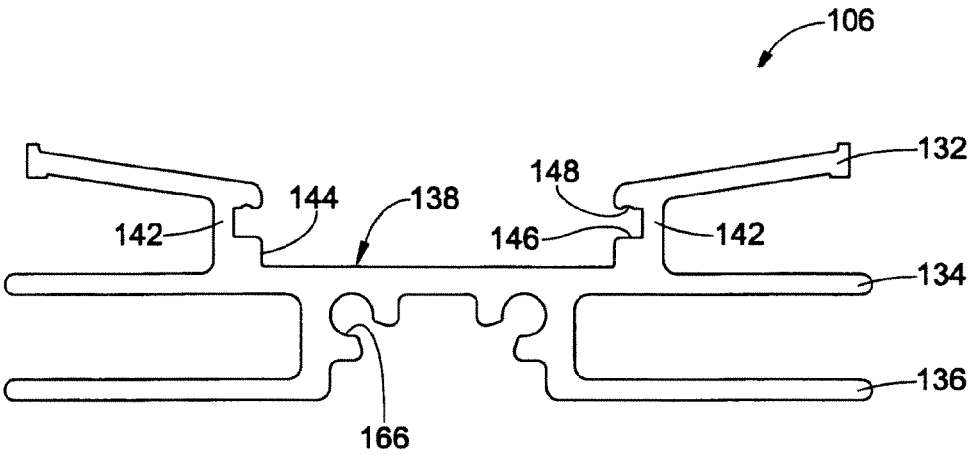
FIG. 15 is an end elevation view of a heat sink of the lighting assembly of FIG. 11.

The MCPCB 104 mounts to the heat sink 106. In the depicted embodiment, the heat sink 106 is made of a heat conductive material, which in the depicted embodiment is an extruded aluminum. The heat sink 106 is symmetrical along its length y, which runs parallel to a longitudinal axis, and includes a plurality of fins that run parallel to the longitudinal axis to increase its surface area for more efficient heat dissipation. The longitudinal axis, as defined herein, is the optical axis of symmetry of the LED. With reference to FIG. 15, upper angled fins 132 provide a mounting location for the reflector 112 and the cover 114 (FIG. 11), which will be described in more detail below. Central fins 134 are disposed below the upper fins 132 and lower fins 136 are disposed below the central fins 134. The heat sink 106 includes a mounting surface 138 that faces and/or contacts the lower surface 118 (FIG. 13) of the MCPCB 104. Two side walls 142 extend from the mounting surface 138 towards the upper fins 132 to define a channel 144 that runs along the longitudinal axis of the MCPCB. This channel 144 receives the MCPCB 104 and the fastening devices 108. As noticeable in FIG. 18, the LEDs 102 are positioned below the height z (the vertical dimension in FIG. 18) of the heat sink 106. Accordingly, the point light sources are effectively hidden from view when the assembly is mounted to the mullion 36 (FIG. 1) inside the enclosure.

In the depicted embodiment, the side walls 142 of the heat sink 106 are at least generally parallel to one another and spaced apart from one another a distance approximately equal to the width of the MCPCB 104. Each side wall 142 includes a cam receiving channel 146 that runs parallel to the longitudinal axis of the heat sink (optical axis of LED). The cam receiving channels 146 are vertically spaced from the mounting surface 138 a distance approximately equal to the height of the MCPCB 104 and are configured to receive a portion of the fastening device 108. In the depicted embodiment, the cam receiving channels 146 run along the entire length of the heat sink 106; however, the channels can be interrupted along the length of the heat sink. Grooves 148 are formed in an upper wall of the cam receiving channels 146. The grooves 148 cooperate with the fastening device 108, in a manner that will be described in more detail below.

Figure 18:
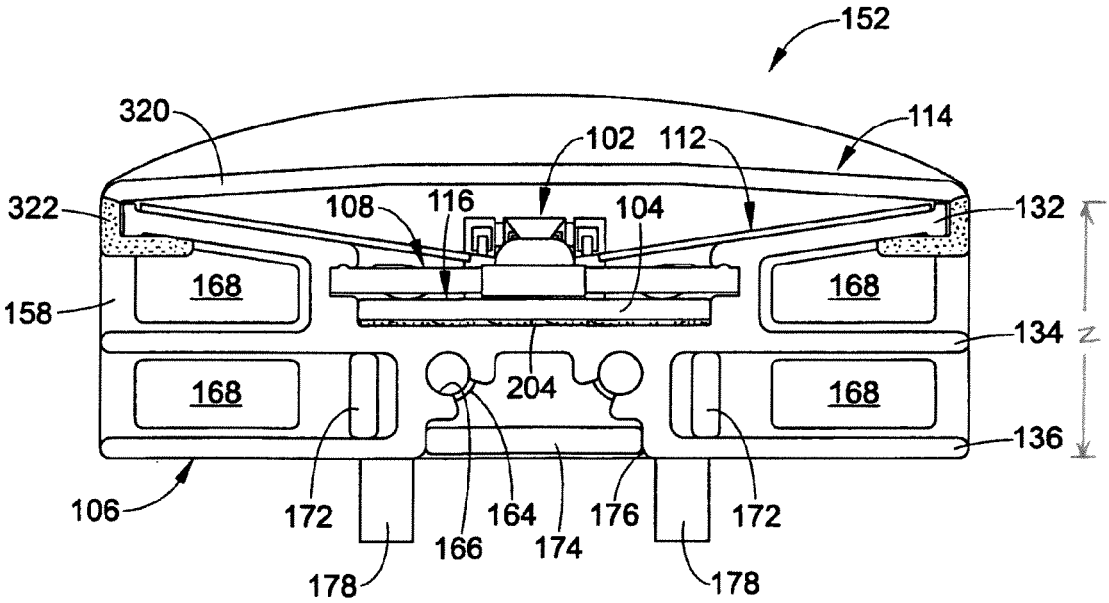
FIG. 18 is a cross-sectional view of the lighting assembly of FIG. 11 when assembled.
Figure 16:
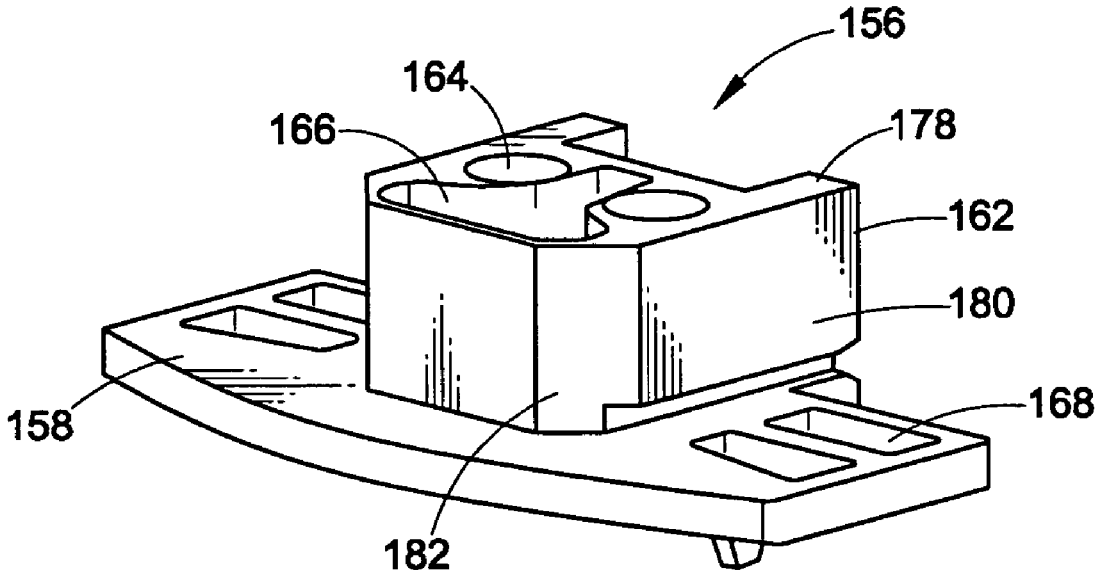
FIG. 16 is a top perspective view of an end cap that mounts to the heat sink of the lighting assembly of FIG. 11.
Figure 17:
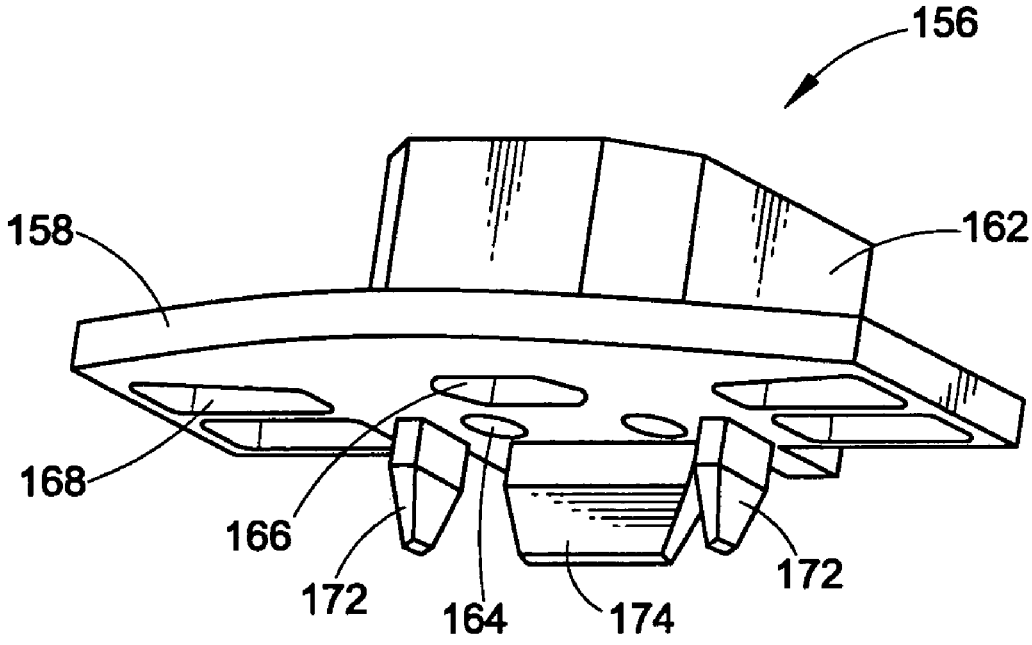
FIG. 17 is a bottom perspective view of the end cap of FIG. 16.

The heat sink 106 mounts to a standard mullion 36 (FIG. 1) of a commercial refrigeration unit, and therefore can have a width, i.e. the horizontal dimension in FIG. 15, that is substantially equal to a standard mullion. With reference back to FIG. 11, end caps 152 can mount to opposite longitudinal ends of the heat sink 106 using fasteners 154. The end caps 152 can provide a mounting structure to facilitate attachment of the lighting assembly to the mullion 36 (FIG. 1). With reference to FIG. 16, in the depicted embodiment the end cap 156 is a unitary body, which can be made of plastic, that includes a base 158 and a pillar 162 that extends upwardly from the base. Fastener openings 164 are formed in the end cap 156 through the pillar 156 and the base 158. When the end cap 156 is mounted to the heat sink 106 the fastener openings 164 align with radially truncated openings 166 (FIG. 15) formed at the ends of the heat sink. The fastener openings 164 and 166 receive the fasteners 154 to attach the end cap 156 to the heat sink 106. Even though a fastener is described as a manner to connect the end cap 156 to the heat sink 106, the end cap can attach to the heat sink in other known manners, for example a resilient clip-type connection, and the like. The end cap 156 also includes an electrical conductor wire opening 166 that is spaced from the fastener opening 164 and extends through both the pillar 162 and the base 158. The electrical conductor opening 166 is dimensioned to receive the electrical conductors 122 (FIG. 12) to allow for an electrical connection between a power source and the LEDs 102. The end cap 156 also includes a plurality of air flow openings 168 formed through the base 158. With reference to FIG. 17, a pair of parallel prongs 172 extend from the base 158 in an opposite direction as the pillar 162. A central prong, which is situated between and perpendicular to the parallel prongs 172, also extends normal to the base 158. With reference to FIG. 18, when the end cap 152 is secured to the heat sink 106, the air openings 168 align such that they are disposed between adjacent fins, for example between the upper fin 132 and the central fin 134, and between the central fin 134 and the lower fin 136. The parallel prongs 172 fit between the lower fins 136 and the central fins 134. The central prong 174 fits into a rear channel 176 formed in the heat sink 106. The end cap also includes stand-offs 178 that extend rearwardly, i.e. away from the LED 102 and the cover 114 when the cap 152 is attached to the heat sink 106. When the assembly 100 is mounted inside a typical commercial refrigeration unit, the assembly attaches to the mullion. The stand-offs 178 space the lower fins 136 of the heat sink 106 from the mullion so that airflow is encouraged between the heat sink and the mullion.

The lighting assembly can be used to retrofit commercial refrigeration units that now include fluorescent tubes. The pillar 162 is dimensioned such that clips that are presently used to mount a fluorescent fixture can cooperate with the pillar 162. The clip travels around opposite peripheral surfaces 180 of the pillar 162 toward forward angled surfaces 182. Accordingly, the assembly can be locked into place similar to a conventional fluorescent lighting assembly. Also, the heat sink can include the mounting structure and the stand-offs as integral portions of the heat sink.

Figure 19:
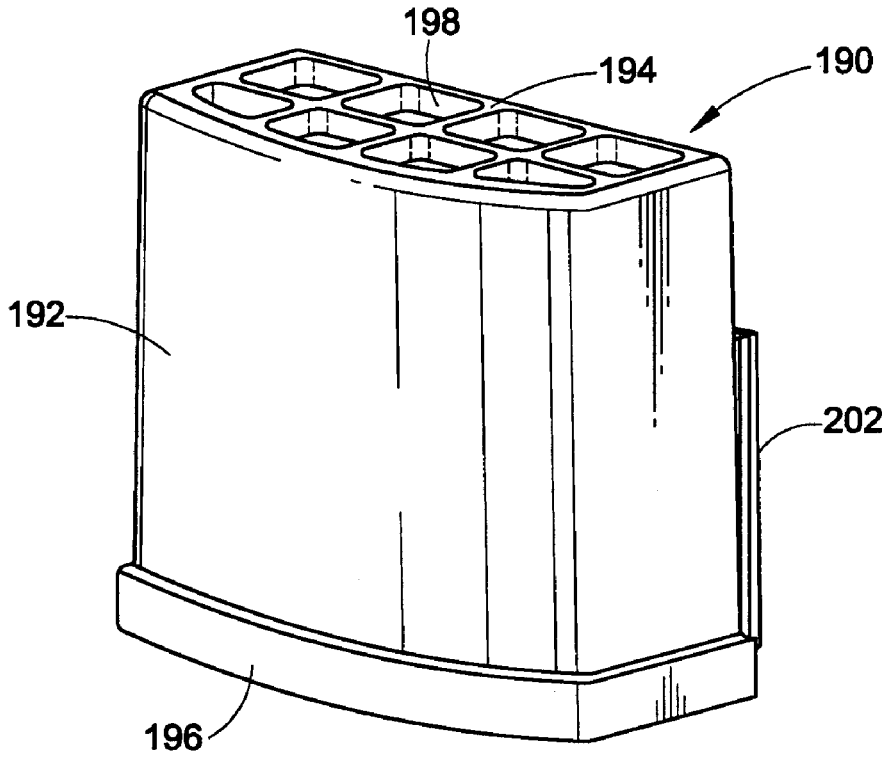
FIG. 19 is a top perspective view of an end cover of the lighting assembly of FIG. 11.
Figure 20:
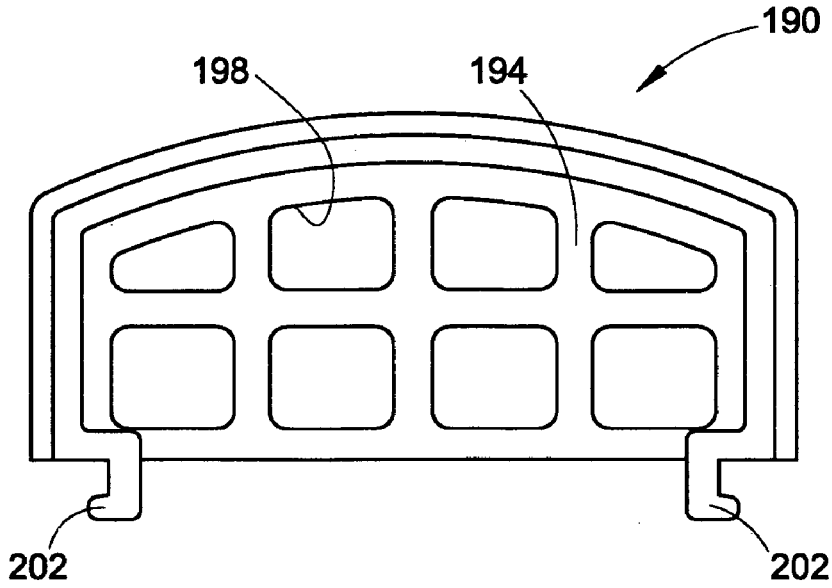
FIG. 20 is a bottom plan view of the end cover of FIG. 19.

With reference to FIG. 19, a cover 190 can mount to the end cap 154. The cover 190 can enclose the electrical wiring that connects to the electrical conductors 122. The cover can also cover other electrical components, such as rectifiers and the like, which will be described in more detail below. The cover 190 includes a side wall 192, a top wall 194 and a lower lip 196. The lower lip 196 is configured similar to the periphery of the end cap 152 so that the cover 190 can snap onto and/or over the end cap 154. A plurality of air vent holes 198 are provided in the top wall 194 of the cover 190. The air vent holes 198 allow air to enter into the cover, which allows airflow around the heat sink 106. L-shaped retaining fingers 202 extend rearwardly from the side wall 192. The retaining fingers 202 attach to the mullion to provide a positive lock, which can provide a secondary mounting mechanism to retain the assembly to the mullion.

With reference back to FIG. 11, the printed circuit board 104 mounts to the heat sink 106 using a fastening device, which will be referred to as a cam 108. The cam 108 holds the MCPCB 104 against the mating surface 138 of the heat sink 12. It is very difficult to manufacture surfaces that are truly flat. Typically, when two "flat" surfaces are brought in contact with one another, three points from the first "flat" surface, i.e. a truly flat plane, contact three points from the second "flat" surface. By applying pressure the MCPCB 104, more points that make up the lower surface 118 of the MCPCB 104 can contact more points that make up the mounting surface 138 of the heat sink 106. Having more points that are in contact with one another results in more efficient thermal energy transfer passing from the MCPCB 104 into the heat sink 106 because heat does not have to travel through air, which is not as conductive as the thermally conductive material of the heat sink. To further facilitate heat transfer between the MCPCB 104 and the heat sink 106, a thermally conductive interface material 204 (FIG. 18), for example a tape having graphite, can be interposed between the lower surface 118 of the MCPCB 104 and the mounting surface 138 of the heat sink 106. In an alternative embodiment, a double-sided thermally conductive tape can be used to attach the MCPCB 104 to the heat sink 106.

Figure 21:
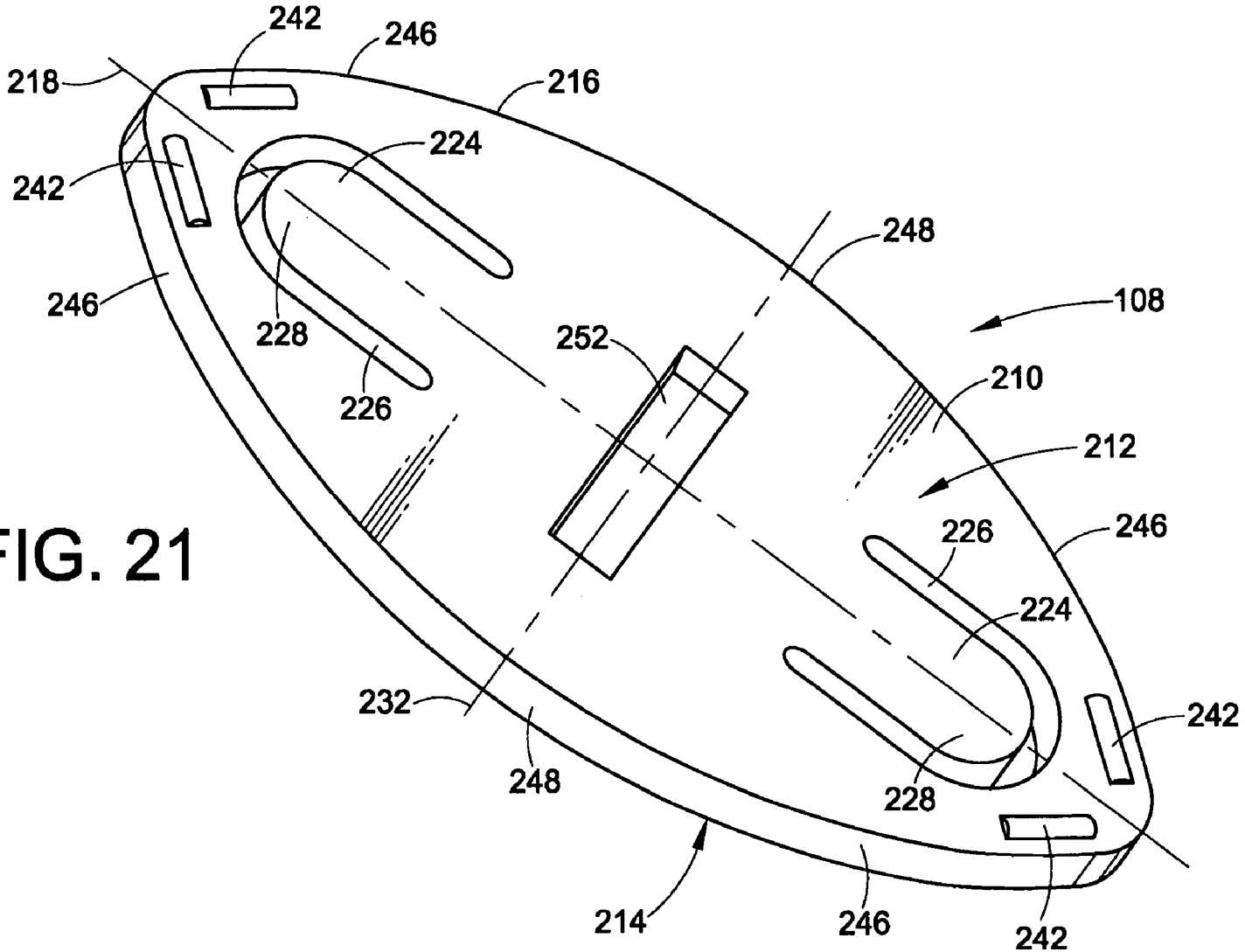
FIG. 21 is a top perspective view of a fastener of the lighting assembly of FIG. 11.

As more clearly seen in FIG. 21, in the depicted embodiment the cam 108 is a substantially planar body 210 made of plastic having opposing at least substantially planar surfaces: upper surface 212 and lower surface 214. The planar body 210 can have a generally American football-shape in plan view such that the planar body 210 is axially symmetric in both a longitudinal axis (optical axis of LED) 218 and a transverse axis 222 and the length of the planar body 210 is greater than its width.

Two tabs 224 that are integral with the cam body 210 are defined by U-shaped cut outs 226 that extend through the planar body 210. The tabs are symmetrical along both the longitudinal axis (optical axis of LED) 218 and the transverse axis 222, extending in opposite directions from the transverse axis 222. The tabs 224 are spaced inward from a peripheral edge 216 of the body 210 and a distal end 228 of each tab 224 is positioned near each longitudinal end of the body 210.

With reference to FIG. 21, protuberances 232 extend away from the lower surface 214 of each tab 224. The protuberances 232 are located near the distal end 228 of each tab 224 and extend away from the tab. In the depicted embodiment, the protuberances 232 are substantially dome-shaped, which limits the contact surface between the protuberance and the upper surface 116 of the MCPCB 104 (FIG. 13). The limited contact between the protuberances 232 and the upper surface 116 limits the amount of friction between the surfaces when the cam 108 is rotated and locked into place, which will be described in more detail below. The tabs 224 acting in concert with the protuberances 232 act as a sort of leaf spring when the cam 108 is locked into place.

With reference back to FIG. 18, the protuberances 232 allow the cam 108 to apply a force on the MCPCB 104 in a direction normal to the mating surface 138 of the heat sink 106. To affix the MCPCB 104 to the heat sink 106, the cam 108 is positioned on the upper surface 116 (FIG. 13) of the MCPCB 104 and a downward force, i.e. a force in a direction normal to the mounting surface 138, is applied to the cam 108. The downward force results in the tabs 224 flexing upward because of the protuberances 232. Then the cam 108 is rotated such that a portion of the peripheral edge 216 is received inside the cam receiving channels 148, as seen in FIG. 18 (not numbered for clarity, see FIG. 15). At least the portion of the body 210 received in the cam receiving channels 148 has a thickness approximately equal to the cam receiving channel 148. With a portion of the body 210 being received in the cam receiving channels 148, the tabs 224 remain flexed upward. The upward flexing of the tabs 224 results in a downward force on the MCPCB 104. Since the tabs 224 are axially symmetric with respect to two axes, a balanced load is applied to the MCPCB 104. To increase the amount of pressure that is applied to the MCPCB 104 by the tabs 224, either the length of the tabs can be changed or the height of the protuberances 232 can be changed.

With reference back to FIG. 21, ridges 242 extend upwardly from the upper surface 212 of the body 210. The ridges 242 run substantially parallel to the portion of the peripheral edge 216 adjacent the ridges 242 Two ridges are provided near each longitudinal end of the body 210 so that the cam 108 can be rotated either in a clockwise or counterclockwise direction to engage the cam receiving channels 148 (FIG. 18). The ridges 242 are semi-cylindrical in configuration so that they can be easily urged into the mating grooves 148 (FIG. 15).

The body 210 of the cam 108 has an appropriate thickness or height and the peripheral edge 216 is appropriately shaped with respect to the dimensions of the channel 144 (FIG. 15) that receives the MCPCB 104 so that when the cam 108 is rotated into the cam receiving channels 146 the ridges 242 are aligned substantially parallel to a longitudinal axis of the heat sink (optical axis of LED) 106. Furthermore, in one embodiment the peripheral edge 216 follows generally linear paths near the longitudinal ends of the cam 108. Linear portions 246 of the peripheral edge 216 are interconnected by curved portions 248 nearer the transverse axis 222 of the body. The curved portions 248 have a generally large radius, which gives the body the substantially football-shaped configuration in plan view. The axially symmetric configuration allows the cam 108 to be rotated in either a clockwise or counterclockwise direction to engage the cam receiving channels 146 (FIG. 15). The linear portions 246 of the peripheral edge 216 provide a longer portion of the body 210 disposed in the cam receiving channel 146 to counteract the upward force applied on the cam 108 by the MCPCB 104. The cam body 210 can take alternative configurations; however, a symmetrical configuration can allow for either clockwise or counterclockwise rotation.

Figure 22:
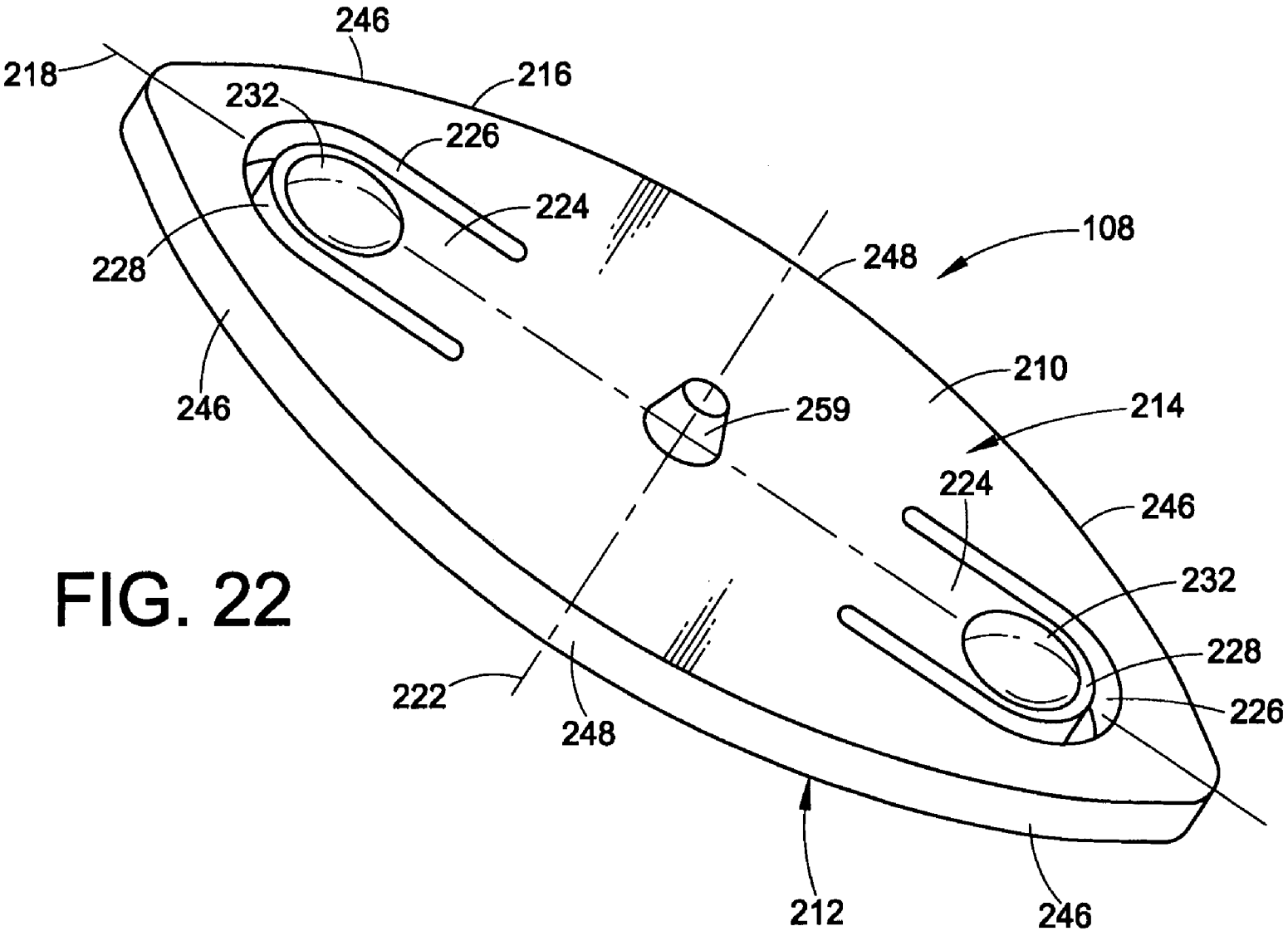
FIG. 22 is a bottom perspective view of the fastener of FIG. 21.

To facilitate rotation of the cam, a recess 252 configured to receive a screwdriver is centrally located on the upper surface 212 of the body 210. With reference to FIG. 22, a locating post 254 is centrally located on the lower surface 214 of the body 210. In one embodiment, a corresponding mating hole 256 (FIG. 1) is provided in the MCPCB 104 for receiving the locating post 254.

As mentioned above, the cam 108, or a plurality of cams, can be used in a lighting assembly, such as that depicted in FIG. 1. As seen in FIG. 1, the reflector 112 and the protective cover 114 can also mount to the heat sink 106, or other structure (not shown) to make up the lighting assembly. The height of the planar body 210 of the cam is less than the height the LED 202 extends above the MCPCB 204 (see FIG. 18). Such a configuration provides a clear path for the light emitted from the LED 202. Even though a substantially planar body 210 for the cam 108 is depicted, other low profile configurations, e.g. nonplanar configurations, can be used where the cam 108 is used to retain a MCPCB 104 having light emitting electrical components mounted to it.

With reference back to FIG. 11, the reflector 112 mounts to at least one of the MCPCB 104 and the heat sink 106. The reflector 112 includes an upper reflective surface 258 and a lower surface 262. The reflective surface 258 directs light emitted from the LEDs towards products that are disposed inside the commercial refrigeration unit. The reflector can include ridges that run parallel to a longitudinal axis of the reflector and the assembly (optical axis of LED). The reflector can comprise metal, plastic, plastic covered with a film, and transparent plastic using the method of total internal reflection to direct light similar to a conventional reflector, as well as other conventional materials. The reflective surface 258 can be polished to further increase the efficacy.

As more clearly seen in FIG. 18, the reflector 112 can have a somewhat V-shaped configuration that includes a substantially planar central portion 264 that runs along the central axis of the reflector 112 and upwardly extending portions 266 that are at an angle to the planar portion 264. The angled portions 266 can be at a shallow angle such as from about 40 to about 150 from the central portion 264 (see FIG. 18), and in one embodiment about 90 from the central portion 264. As more clearly seen in FIG. 18, the lower surface 262 of the reflector 112 contacts the upper fins 132 of the heat sink and terminates near a longitudinal edge of the upper fins 132.

The reflector 112 includes notches 268 formed at each longitudinal end of the reflector. The notches are dimensioned to fit around the connectors 124 and 126 (FIGS. 13 and 14). The reflector also includes electrical connector openings 272 that are dimensioned to receive the connectors 124 and 126 that connect adjacent printed circuit boards 104 to one another. The reflector also includes LED openings 274 that are appropriately dimensioned to receive the LEDs 102 that are mounted on the MCPCB 104. The notches 268, the electrical connector openings 272, and the LED openings 274 are aligned along a central longitudinal axis (optical axis of LED) of the reflector 112, and thus are formed in both the central portion 264 and the upwardly angled portions 266.

Figure 23:
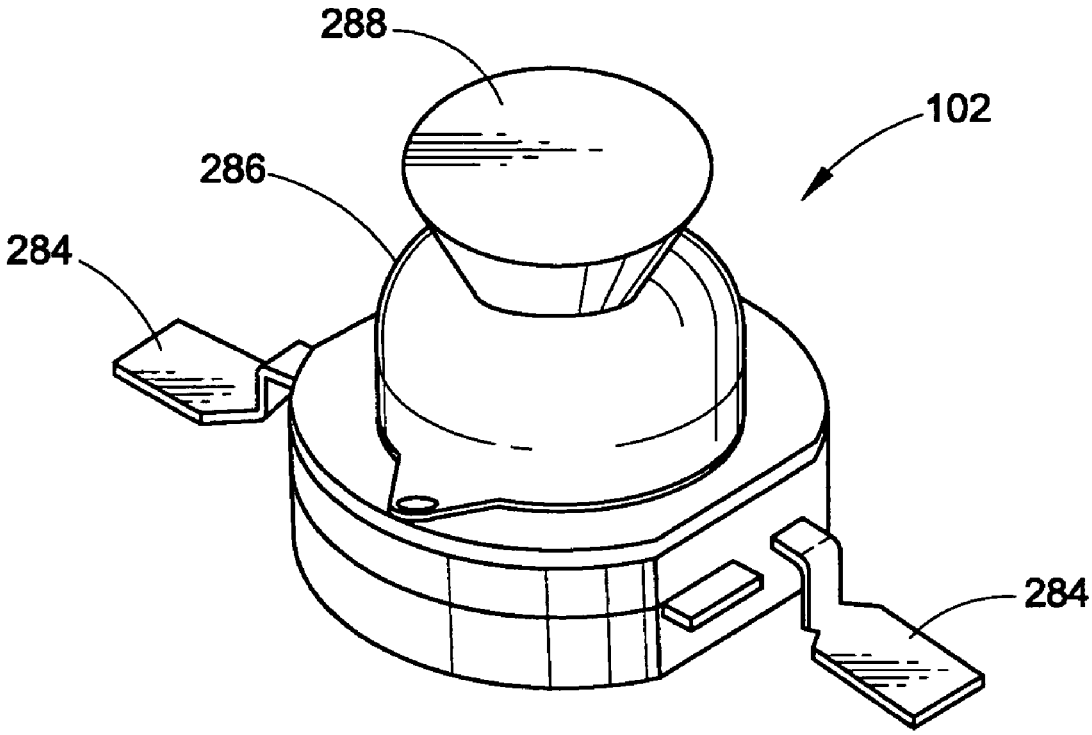
FIG. 23 is a top perspective view of an LED of the lighting assembly of FIG. 11.
Figure 24:
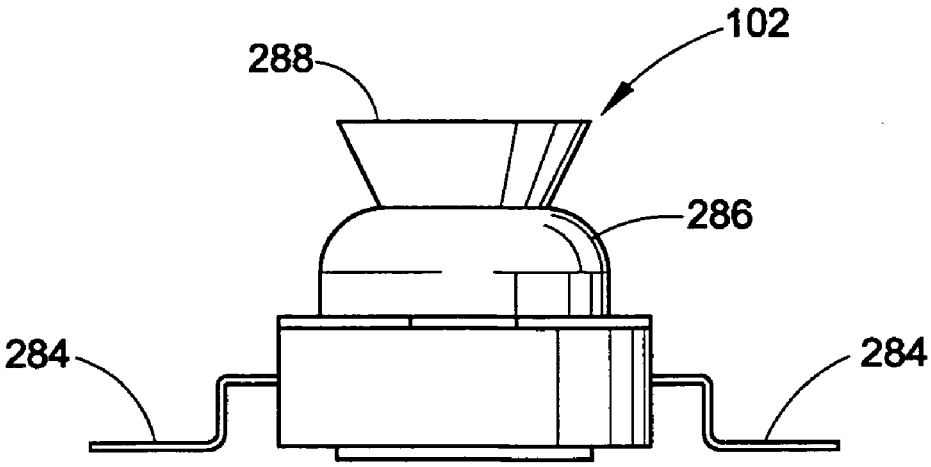
FIG. 24 is a side elevation view of the LED of FIG. 23.
Figure 25:
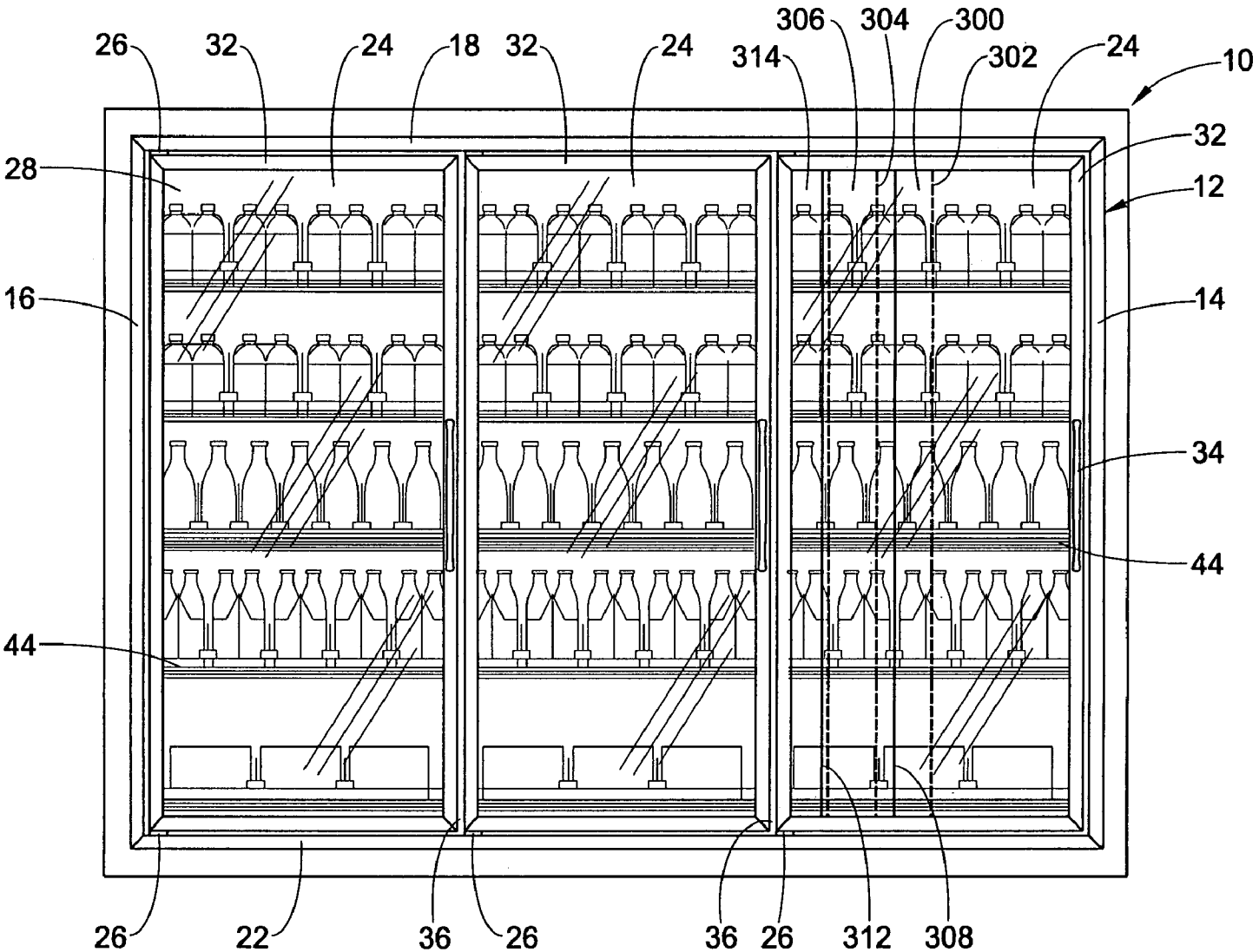
FIG. 25 is a front view of a refrigerated enclosure showing light beam patterns generated by the light assembly of FIG. 11.

With reference to FIG. 23, the LEDs 102 that are used in the depicted embodiment are side emitting LEDs, which are available from LumiLeds Lighting, U.S. LLC. Each LED includes a lens 280 that mounts onto an LED body 282. Each LED includes a pair of leads 284 that electrically connect with the contacts (not shown) on the upper surface 116 of the MCPCB 104. The lens 280 directs light emitted from the LED such that a majority of the light is emitted at a side 286 of the lens as opposed to at a top 288 of the lens. By using a side emitting LED 102, the profile of the lighting assembly 100 can be very thin. Accordingly, a consumer viewing the inside of the commercial refrigeration unit 10 does not see a plurality of point light sources, which has been found to be undesirable. Instead, the LEDs are hidden from the eyes of the consumer by the heat sink 106 and the cover 114. In addition to side emitting LEDs, the lambertian devices that have been previously described can also be used with this assembly.

The LEDs 102 and the reflector 112 are configured to provide a light beam pattern that sufficiently illuminates products disposed in a commercial refrigeration unit. With reference to FIG. 23, light beam patterns generated by the LEDs 102 and one-half of the reflector 112, i.e. one of the angled portions 266, is shown. Similar light beam patterns can be generated on an opposite side of the mullion 36. Light is directed away from the longitudinal axis of the assembly (optical axis of LED) so that one assembly can be used to provide light to opposite sides of the mullion. In the depicted embodiment, a first light beam pattern 300, which is roughly defined between vertical dashed lines 302 and 304 is provided by direct light, i.e., light that does not bounce off the reflector 112. A central light beam pattern 306, which is roughly defined by solid lines 308 and 312 is provided by reflected light, i.e. light that reflects off of the reflector 112. A third light beam pattern 314 is provided by direct light.

A cover 114 mounts to the heat sink 106. The cover includes a clear and/or translucent portion 320 and darkened side portions 322 that fit around the upper fins 132 of the heat sink 106 as seen in FIG. 18. The darkened side edges 322 can further obscure the LEDs 102 from the consumer when the light assembly is mounted inside a commercial refrigeration unit.

The translucent portion 320 of the protective cover 114 can be tinted to adjust the cover of the light emitted by the assembly. Alternatively, the reflective surface 258 of the reflector 112 can also be tinted to adjust the color of the light emitted from the assembly 100.

The light assembly 100 can be used in a retrofit installation. The LEDs 102 can be in electrical communication with a power conditioning circuit depicted schematically at 330 in FIG. 11. The power conditioning circuit 330 can convert alternating current voltage to a direct current voltage. The power conditioning circuit for example can be adapted to convert 120 or 240 volt alternating current voltage to a direct current voltage. Also, the power conditioning circuit 330 can correct for polarity of the incoming power so that the power supply wires that connect to the power conditioning circuit can be connected without having to worry about which wire connects to which element of the power conditioning circuit. The power conditioning circuit can be located on the printed circuit board 104, or alternatively the power conditioning circuit can be located off of the printed circuit board 104. For example, in one embodiment the power conditioning circuit can be located on an element that is disposed inside the cover 190 that mounts to the end cap 156.

Figure 26:
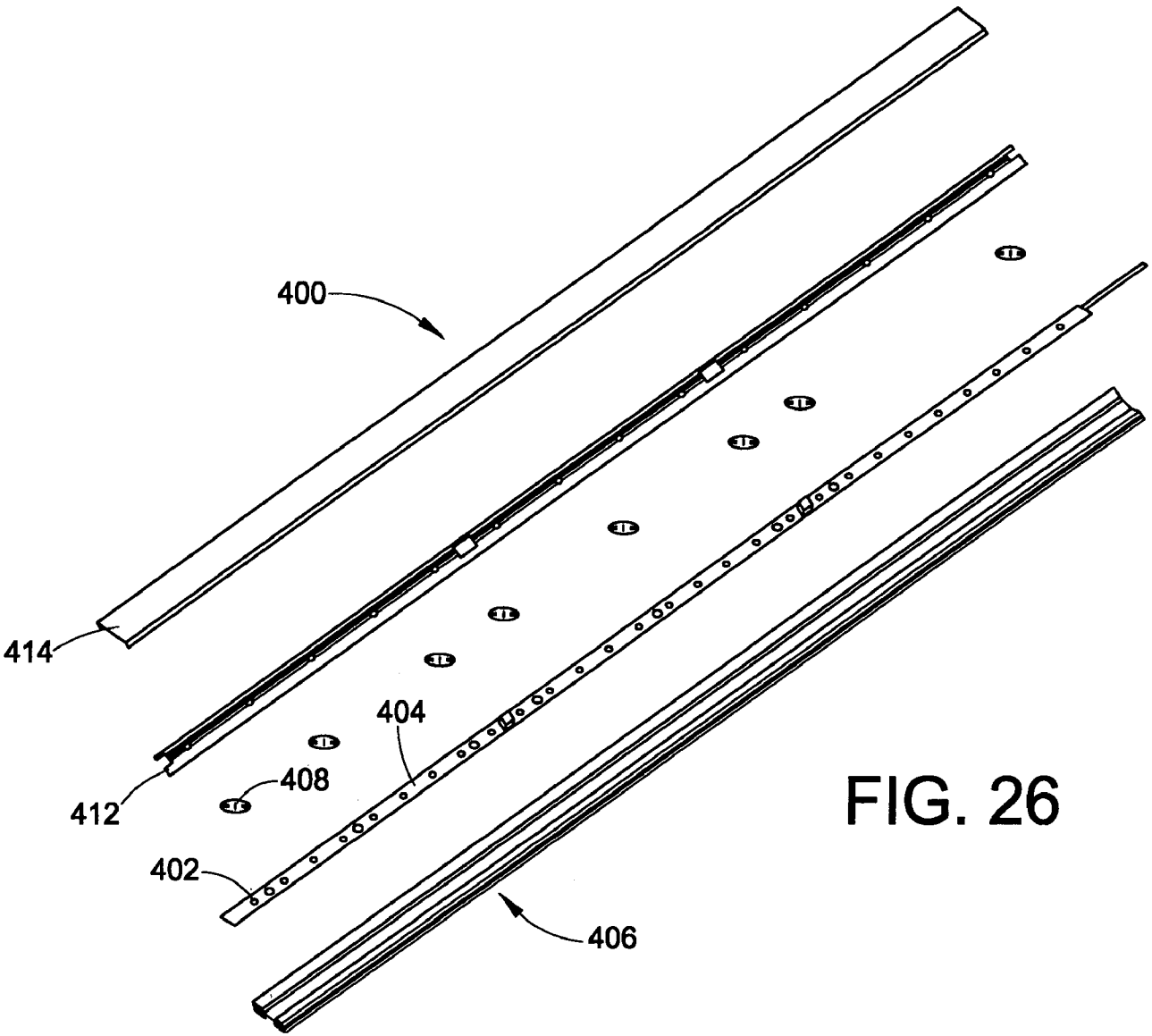
FIG. 26 is an exploded view of a lighting assembly that can be mounted in a corner of a display case.

With reference to FIG. 26, another embodiment of a lighting assembly 400 is disclosed. The lighting assembly 400 is similar to the lighting assembly described with reference to FIGS. 11-25. This lighting assembly 400, however, is adapted to be mounted in a corner of a display case such that light is typically directed to only one side of the assembly. The lighting assembly 400 includes a plurality of LEDs 402 mounted on printed circuit boards 404. The printed circuit boards 404 mount to a heat sink 406 using fastening devices 408. A reflector 412 also connects to the heat sink 406. A translucent cover 414 also attaches to the heat sink 406 and covers the LEDs 402. In this embodiment, the LEDs 402, the circuit board 404, and the fastening devices 408 are the same, or very similar, to the devices described with reference to FIGS. 11-25. In this embodiment, the heat sink 406 has a smaller width than the heat sink 106 described with reference to FIGS. 11-25. This allows the heat sink to connect to a corner mullion, which is typically smaller than a central mullion. The reflector 412 is also slimmer as compared to the reflector 112 described above. The reflector is still somewhat V-shaped and includes a substantially planar central region and upwardly extending portions. As seen in FIG. 26, one of the extending portions extends a greater distance from the central region as compared to the opposite extending portion. The lighting assembly 400 described in FIG. 26 can mount to the mullion in a manner similarly to the lighting assembly 100 described above.

The lighting systems have been described with reference to preferred embodiments. Modifications and alterations will occur to those upon reading the preceding detailed description. Furthermore, components that are described as a part of one embodiment can be used with other embodiment. As just one example, the sensor devices and warning indicators described can be utilized with each of the embodiments. The invention comprises all such modifications and alterations that would occur to one skilled in the art from reading the above detailed description that are covered by the claims or the equivalents thereof.

The invention claimed is:

1. A lighting assembly for illuminating a display case, the assembly comprising:

an elongated heat sink that is symmetrical along a longitudinal axis and is in thermal communication with a plurality of LEDs, wherein the longitudinal axis comprises an optical axis of the LEDs, the elongated heat sink being dimensioned having a height z and a length y, which is the greatest dimension, each LED device being disposed below the height z such that each LED device is not visible when viewing the assembly from a side along the length y, wherein the elongated heat sink includes at least an upper fin, central fin, and lower fin that run parallel to and are disposed on opposite sides of the longitudinal axis, wherein the upper fins are angled downwardly toward the longitudinal axis and include an upper longitudinal edge that is disposed above the LED devices;

at least one reflector disposed in relation to the LED devices to reflect light emitted from the LED device, wherein the reflector is shaped to direct light in opposite directions away from the longitudinal axis of the assembly; and a cover including a translucent middle portion and integral darkened side portions adapted to fit around the upper longitudinal edge of the upper fins of said heat sink, wherein the darkened side portions further obscure the LED devices from view and do not transmit light.

2. The assembly of claim 1, further comprising power conditioning circuitry for converting AC power to DC power and for correcting polarity of the power.

3. The assembly of claim 1, further comprising a stand off connected to the heat sink for spacing the heat sink from a surface of the display case.

4. The assembly of claim 1, further comprising a mounting structure connected to the heat sink, wherein the mounting structure is configured to be received by a clip used to mount a fluorescent fixture inside a refrigerated display.

5. The assembly of claim 1, further comprising a thermally conductive substrate upon which each LED device is mounted, the LED devices being in thermal communication with the heat sink via the thermally conductive substrate.

6. The assembly of claim 5, further comprising a thermally conductive layer interposed between the substrate and the heat sink, the thermally conductive layer filling voids that occur when the substrate is brought adjacent the heat sink.

7. The assembly of claim 1, wherein the reflector is shaped and disposed in relation to each LED device such that the reflector allows light from the LED devices to pass over the reflector to illuminate products disposed in the display case.

8. The assembly of claim 1, further comprising an end cap attached to the heat sink, wherein the end cap and the heat sink each include fastener openings to receive a fastener for attaching the end cap to the heat sink.

9. The assembly of claim 1, wherein the reflector includes LED openings extending through the reflector and aligned with the longitudinal axis, each LED opening receiving a respective LED device.

10. A light assembly for illuminating products in a refrigerated display case on opposite sides of a mullion, the assembly comprising:

a thermally conductive printed circuit board wherein a plurality LED devices are mounted to an upper surface of the circuit board;

a heat sink having a plurality of fins, including at least a pair of upper fins disposed on opposite sides of the longitudinal axis, that run parallel to and are angled downwardly toward the longitudinal axis, in thermal communication with the LEDs, wherein the longitudinal axis comprises an optical axis of the LEDs, wherein heat from the LEDs is drawn through the circuit board and dissipated through a lower surface of the circuit board into the heat sink;

an end cap connected to a longitudinal end of the heat sink;

a reflector disposed in relation to the LEDs such that light is directed into the display case and away from the longitudinal axis toward opposite sides of the mullion, said reflector including at least one ridge that run parallel to said longitudinal axis; and a cover disposed over the LEDs and connected to both the heat sink and the end cap, the cover including a translucent middle portion and integral darkened side portions adapted to fit around an upper longitudinal edge of the upper fins of said heat sink.

11. The light assembly of claim 10, wherein the heat sink has a width about equal to a width of the mullion.

12. The assembly of claim 10, wherein the upper fins include a mounting surface for the reflector.

13. The assembly of claim 12, wherein the upper fin of the heat sink vertically taller than the LEDs and the LEDs are positioned below the height z.

14. A light assembly for illuminating a display case comprising:

an elongated heat sink having a channel and angled heat fins, including at least a pair of upper fins disposed on opposite sides of said channel, running along a greatest dimension of the heat sink; wherein the longitudinal axis comprises an optical axis of each LED, a printed circuit board ("PCB") received in the channel of the heat sink;

a plurality of LED devices mounted along a longitudinal axis of the PCB and in thermal communication with the heat sink, the LED devices being disposed below an uppermost edge of the upper fins so that the LED devices are not visible when viewing the assembly from a side along the greatest dimension of the heat sink;

a reflector connected to the heat sink for directing light from at least one of the LED devices in a direction away from the longitudinal axis of the assembly, said reflector including at least one ridge that runs parallel to said longitudinal axis; and a cover including a translucent top portion and integral darkened side portions adapted to fit around the upper longitudinal edge of the upper fins of said heat sink wherein the darkened side portions further obscuring the LED devices from view and do not transmit light.

15. The assembly of claim 14, wherein a lower surface of the reflector contacts the upper fin of the heat sink.

16. A lighting assembly for illuminating a display case, the assembly comprising:

a circuit board having a longitudinal dimension substantially longer than a width of the circuit board;

a plurality of LED devices disposed on the circuit board along the longitudinal extent of the circuit board, said LED devices in thermal communication with the circuit board;

an elongated heat sink in thermal communication with the circuit board, the longitudinal extent of the heat sink corresponding to the longitudinal extent of the circuit board, the heat sink comprising:

a circuit board mounting surface along the longitudinal extent of the heat sink; and a downwardly angled fin extending along the longitudinal extent of the heat sink on opposite sides of the circuit board mounting surface;

a reflector in light reflecting relationship with the LED devices to reflect side-emitted light from the LED devices in a direction away from the longitudinal extent of the assembly such that most of the emitted light is reflected to either side of the assembly in a direction that is not perpendicular to the circuit board mounting surface, said reflector including at least one ridge that run parallel to said longitudinal extent of the assembly; and a cover including a translucent middle portion and integral darkened side portions adapted to fit around the upper longitudinal edge of the downwardly angled fin of said heat sink, the cover attaching to the heat sink and wherein the darkened side portions further obscuring the LED devices from view and do not transmit light.

17. The assembly of claim 16, wherein an upper edge of each fin extends away from and above an upper surface of the LED devices.

* * * * *